US007673670B2

(12) United States Patent
Higashiyama et al.

(10) Patent No.: US 7,673,670 B2
(45) Date of Patent: Mar. 9, 2010

(54) SEMIFINISHED JOINT PLATE, JOINT PLATE, PROCESS FOR FABRICATING JOINT PLATE AND HEAT EXCHANGER

(75) Inventors: Naohisa Higashiyama, Oyama (JP); Kenji Tsunoda, Oyama (JP)

(73) Assignee: Showa Denko K.K., Tokyo (JP)

( * ) Notice: Subject to any disclaimer, the term of this patent is extended or adjusted under 35 U.S.C. 154(b) by 933 days.

(21) Appl. No.: 10/583,375

(22) PCT Filed: Mar. 8, 2005

(86) PCT No.: PCT/JP2005/004409

§ 371 (c)(1),
(2), (4) Date: Jun. 19, 2006

(87) PCT Pub. No.: WO2005/085739

PCT Pub. Date: Sep. 15, 2005

(65) Prior Publication Data

US 2007/0215331 A1 Sep. 20, 2007

Related U.S. Application Data

(60) Provisional application No. 60/559,961, filed on Apr. 7, 2004.

(30) Foreign Application Priority Data

Mar. 9, 2004 (JP) ..... 2004-065615
Mar. 7, 2005 (JP) ..... 2005-061857

(51) Int. Cl.
*F28D 1/053* (2006.01)

(52) U.S. Cl. ..... 165/79; 165/153; 165/176; 165/178; 29/890.054

(58) Field of Classification Search ..... 165/153, 165/176, 178, 79, 135; 29/890.054
See application file for complete search history.

(56) References Cited

U.S. PATENT DOCUMENTS

| | | | | |
|---|---|---|---|---|
| 5,826,648 | A * | 10/1998 | Shimoya et al. | 165/153 |
| 6,272,881 | B1 * | 8/2001 | Kuroyanagi et al. | 165/153 |
| 6,453,990 | B2 * | 9/2002 | Higashiyama et al. | 165/178 |
| 6,502,305 | B2 * | 1/2003 | Martins et al. | 165/135 |
| 2002/0029869 | A1 | 3/2002 | Kodumudi et al. | |
| 2005/0172664 | A1 * | 8/2005 | Cho et al. | 165/176 |

FOREIGN PATENT DOCUMENTS

JP 2001-241881 9/2001

* cited by examiner

*Primary Examiner*—Leonard R Leo
(74) *Attorney, Agent, or Firm*—Oblon, Spivak, McClelland, Maier & Neustadt, L.L.P.

(57) ABSTRACT

A semifinished joint plate 60 has a refrigerant inlet portion 45 and a refrigerant outlet portion 46 spaced apart in the front-rear direction. The semifinished plate 60 has an upwardly or downwardly extending slit 61 formed between the inlet portion 45 and the outlet portion 46, and slit width adjusting portions 62, 63 extending through the thickness of the plate 60, having a larger width than the slit 61 and communicating respectively with the upper and lower ends of the slit 61. A portion of the semifinished plate 60 above the upper adjusting portion 62 and a portion thereof below the lower adjusting portion 63 are bent to shorten the plate.

18 Claims, 13 Drawing Sheets

SEMIFINISHED JOINT PLATE, JOINT PLATE, PROCESS FOR FABRICATING JOINT PLATE AND HEAT EXCHANGER

CROSS REFERENCE TO RELATED APPLICATION

This application is an application filed under 35 U.S.C. §111(a) claiming the benefit pursuant to 35 U.S.C. §119(e)(1) of the filing date of Provisional Application No. 60/559,961 filed Apr. 7, 2004 pursuant to 35 U.S.C. §111(b).

TECHNICAL FIELD

The present invention relates to semifinished joint plates, joint plates, a process for fabricating joint plates, and heat exchangers, and more particularly to semifinished joint plates for making joint plates for use in heat exchangers useful as evaporators for motor vehicle air conditioners which are refrigeration cycles to be installed in motor vehicles, joint plates, a process for fabricating the joint plate and heat exchangers.

The term "aluminum" as used herein and in the appended claims includes aluminum alloys in addition to pure aluminum. The downstream side (the direction indicated by the arrow X in FIG. 1, and the right-hand side of FIGS. 4, 5 and 8) of the air to be passed through the air flow clearance between each adjacent pair of heat exchange tubes will be referred to herein and in the appended claims as "front," and the opposite side as "rear." Further the upper, lower, and left- and right-hand sides of FIG. 2 will be referred to as "upper," "lower," "left" and "right," respectively.

BACKGROUND ART

Evaporators are already widely known which comprise a plurality of flat hollow bodies arranged in parallel and each composed of a pair of dishlike plates facing toward each other and brazed to each other along peripheral edges thereof, a refrigerant inlet header and a refrigerant outlet header arranged side by side in the front-rear direction, and a refrigerant circulating passage for holding the two headers in communication with each other therethrough, the inlet header having a refrigerant inlet at one end thereof, the outlet header having a refrigerant outlet at one end thereof alongside the inlet end, the refrigerant inlet and outlet being formed by making two through holes in the outer plate of the flat hollow body at one end, a refrigerant being permitted to flow from the refrigerant inlet into the inlet header and to return to the outlet header through the circulating passage so as to be sent out from the refrigerant outlet.

With such an evaporator, a joint plate having a short tubular refrigerant inlet portion in communication with the refrigerant inlet and a short tubular refrigerant outlet portion in communication with the refrigerant outlet is joined to the outer plate of the end hollow body so as to face both the inlet header and the outlet header. One end of a refrigerant inlet pipe is inserted into and joined to the refrigerant inlet portion, and a refrigerant outlet pipe having a larger diameter than the inlet pipe has its one end inserted into and joined to the refrigerant outlet portion. The center of the inlet portion of the joint plate is positioned at the same level as the center of the outlet portion thereof. The known joint plate has a short circuit preventing slit formed between the inlet and outlet portions and extending from the upper end or lower end of the plate (see, for example, the publication of JP-A No. 2001-241881). The slit is adapted to prevent short-circuiting between the inlet header and the outlet header in the event of a fault occurring in the brazing joint at the portion of the joint plate between the inlet and outlet portions thereof and the portion between the inlet and the outlet of the flat hollow body. In the event of short-circuiting, the refrigerant admitted through the refrigerant inlet pipe flows into the refrigerant outlet pipe without flowing through the circulating passage, failing to contribute to refrigeration in any way and resulting in seriously impaired refrigeration performance.

It is required in recent years to compact the air conditioner evaporator to be disposed inside vehicle compartments and also to reduce the dimension thereof in the front-rear direction. To diminish the front-to-rear dimension, it is required that the front-to-rear length of the joint plate disclosed in the above publication be decreased, for example, to not larger than 50 mm, whereas in this case, the short circuit preventing slit can not always be provided. If the joint plate disclosed in the publication is made smaller in the front-to-rear length, there is a need to reduce the spacing between the refrigerant inlet portion and the refrigerant outlet portion and to reduce the width of the short circuit prevent slit. However, since the short circuit preventing slit in the joint plate of the publication is formed by press work, the lower limit to the slit width is restricted, and the slit can not be made if the inlet portion and the outlet portion are spaced apart by a small distance.

Accordingly, it appears feasible to individually make an inlet joint plate having a refrigerant inlet portion communicating with the refrigerant inlet of the inlet header and an outlet joint plate having a refrigerant outlet portion communicating with the refrigerant outlet of the outlet header and to join the inlet joint plate to the inlet header and the outlet joint plate to the outlet header. This nevertheless results in an increased number of components, entailing the problem that the joint plates will not be efficiently incorporated into the evaporator to be fabricated.

An object of the present invention is to overcome the above problem and to provide a semifinished joint plate for readily affording a joint plate which is reliably adapted to prevent short-circuiting between the refrigerant inlet header of a heat exchanger and the refrigerant outlet header thereof and which permits the joint plate to be incorporated, with an improved efficiency, into the heat exchanger to be fabricated, the object of the invention further being to provide the joint plate, a process for fabricating the joint plate, and the heat exchanger.

DISCLOSURE OF THE INVENTION

To fulfill the above object, the present invention comprises the following modes.

1) In a heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, a semifinished joint plate for making a joint plate joined to both the inlet header and the outlet header and having a refrigerant inlet portion in communication with the refrigerant inlet and a refrigerant outlet portion in communication with the refrigerant outlet, the semifinished joint plate having a refrigerant inlet portion and a refrigerant outlet portion arranged in a front-rear direction at a spacing, a slit formed between the inlet portion and the outlet portion and extending upward or downward, and slit width adjusting portions extending through the thickness of the semifinished plate and communicating with respective upper and lower ends of the slit.

2) A semifinished joint plate according to par. 1) wherein the slit width adjusting portions have a dimension in the front-rear direction larger than the width of the slit in the front-rear direction.

3) A semifinished joint plate according to par. 2) wherein the slit width adjusting portions are each in the form of a generally triangular through hole and each have a width increasing as the hole extends away from the slit.

4) A semifinished joint plate according to par. 1) wherein the inlet portion and the outlet portion have respective centers positioned at the same level.

5) A semifinished joint plate according to par. 1) wherein the inlet portion and the outlet portion have respective short cylinders projecting in the same direction.

6) A semifinished joint plate according to par. 5) wherein the short cylinder of the inlet portion is smaller than the short cylinder of the outlet portion in outside diameter.

7) In a heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, a joint plate joined to both the inlet header and the outlet header and having a refrigerant inlet portion in communication with the refrigerant inlet and a refrigerant outlet portion in communication with the refrigerant outlet, the joint plate being made from a semifinished joint plate according to par. 1) by bending a portion of the semifinished plate above the upper slit width adjusting portion and a portion thereof below the lower slit width adjusting portion in the direction of width of the semifinished joint plate to thereby shorten the semifinished plate in the front-rear direction, decrease the width in the front-rear direction of the slit and cause the inlet portion and the outlet portion to communicate with the inlet of the inlet header and the outlet of the outlet header respectively.

8) In a heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, a joint plate joined to both the inlet header and the outlet header and having a refrigerant inlet portion in communication with the refrigerant inlet and a refrigerant outlet portion in communication with the refrigerant outlet, the joint plate being made from a semifinished joint plate according to par. 5) by bending a portion of the semifinished joint plate above the upper slit width adjusting through hole and a portion thereof below the lower slit width adjusting through hole in a direction opposite to the direction of projection of the inlet portion and the outlet portion to thereby shorten the semifinished joint plate in the front-rear direction, decrease the width in the front-rear direction of the slit and cause the inlet portion and the outlet portion to communicate with the inlet of the inlet header and the outlet of the outlet header respectively.

9) A joint plate according to par. 7) or 8) wherein the slit is up to 1 mm in width in the front-rear direction after adjustment.

10) A process for fabricating a joint plate according to par. 7) including making a semifinished joint plate according to par. 1) by a method including drawing a metal plate to form a refrigerant inlet bulging portion and a refrigerant outlet bulging portion both projecting in the same direction and each in the form of a short hollow cylinder having a closed top wall, forming a refrigerant inlet portion and a refrigerant outlet portion by making a through hole in the top wall of each of the bulging portions centrally thereof and raising a top wall portion defining the through hole outward to make an upright portion, stamping out a blank of specified shape from the metal plate, forming an upwardly or downwardly extending slit in the blank between the inlet portion and the outlet portion and further forming slit width adjusting portions extending through the thickness of the blank and communicating with respective upper and lower ends of the slit; and thereafter bending a portion of the semifinished joint plate above the upper slit width adjusting portion and a portion thereof below the lower slit width adjusting portion in the direction of thickness of the semifinished joint plate to thereby shorten the semifinished plate in a front-rear direction and decrease the width in the front-rear direction of the slit.

11) A process for fabricating a joint plate according to par. 10) wherein a portion of the semifinished joint plate above the upper slit width adjusting portion and a portion thereof below the lower slit width adjusting portion are bent in a direction opposite to the direction of projection of the inlet portion and the outlet portion.

12) A heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, the heat exchanger further comprising a joint plate according to par. 7), the joint plate being joined to both the inlet header and the outlet header and having a refrigerant inlet portion and a refrigerant outlet portion in communication with the inlet of the inlet header and the outlet of the outlet header respectively.

13) A heat exchanger according to par. 12) wherein the refrigerant circulating passage comprises an intermediate header opposed to the inlet header, an intermediate header opposed to the outlet header, a plurality of intermediate headers opposed to each other and a plurality of heat exchange tubes, and a plurality of heat exchange tubes are arranged at a spacing between each of the opposed pair of inlet header and intermediate header, the opposed pair of outlet header and intermediate header and the opposed pair of intermediate headers to provide a tube group in the form of at least one row and constitute a heat exchange core, the heat exchange tubes of the tube group having opposite ends jointed to the respective headers of the opposed pair.

14) A heat exchanger according to par. 12) wherein the refrigerant circulating passage comprises a refrigerant inflow header opposed to the inlet header, a refrigerant outflow header opposed to the outlet header and a plurality of heat exchange tubes, the inflow header and the outflow header being in communication with each other to provide a refrigerant turn portion, and a plurality of heat exchange tubes being arranged at a spacing between each of the opposed pair of inlet header and inflow header and the opposed pair of outlet header and outflow header to provide a tube group in the form of at least one row and constitute a heat exchange core, the heat exchange tubes of the tube group having opposite ends joined to the respective headers of the opposed pair.

15) A heat exchanger according to par. 12) wherein a portion of the joint plate above the upper slit width adjusting portion and a portion thereof below the lower slit width adjusting portion are bent toward the inlet header and the outlet header, and the bent portions are in engagement with respective engaging portions provided between the inlet header and the outlet header.

16) A heat exchanger according to par. 14) wherein the outlet header has interior divided by separating means into first and second two spaces arranged in the direction of height, and the heat exchange tubes extend into the first space, the separating being provided with a refrigerant passing hole, the second space of the outlet header being in communication with the refrigerant outlet.

17) A refrigeration cycle comprising a condenser and an evaporator, the evaporator comprising a heat exchanger according to any one of pars. 12) to 16).

18) A vehicle having installed therein a refrigeration cycle according to par. 17) as a vehicle air conditioner.

A portion of the semifinished joint plate described in par. 1) above the upper slit width adjusting portion and a portion thereof below the lower slit width adjusting portion are bent in the direction of thickness of the semifinished plate to thereby shorten the semifinished plate in the front-rear direction and decrease the width in the front-rear direction of the slit, whereby a joint plate can be made which has refrigerant inlet and outlet portions communicating respectively with the inlet of the inlet header and the outlet of the outlet header, and a short circuit preventing slit.

Thus, the front-to-rear width of the short circuit preventing slit of the joint plate to be made is adjustable as desired, and the front-to-rear length required of the joint plate to be formed is accordingly shortened, so that the slit can be formed in the joint plate even when there is a need to decrease the spacing between the inlet portion and the outlet portion and to reduce the front-to-rear width of the slit. Consequently, in heat exchangers wherein a joint plate made from the semifinished joint plate is used, the short-circuiting between the inlet header and the outlet header can be prevented reliably, obviating the likelihood that the refrigerant flowing into the inlet header from the inlet will enter the outlet header without passing through the refrigerant circulating passage. As a result, the whole refrigerant normally contributes to heat exchange to avoid the impairment of heat exchange performance. Moreover, the slit can be formed in the semifinished joint plate easily by a usual method because the spacing between the inlet portion and the outlet portion is larger in the semifinished plate than in the joint plate fabricated. Since the joint plate made from the semifinished plate has an integral structure, the joint plate can be efficiently incorporated into the heat exchanger to be fabricated without increasing the number of components.

The joint plate described in par. 2) ensures accurate adjustment of the slit width.

With the semifinished joint plate according to par. 3), the portion of the semifinished plate above the upper slit width adjusting portion and the portion thereof below the lower slit width adjusting portion can be bent relatively easily in making the joint plate.

In the case where the centers of the inlet portion and the outlet portion are positioned at the same level as in the semifinished joint plate described in par. 4), there is a need to decrease the spacing between the inlet portion and the outlet portion and to reduce the front-to-rear width of the short circuit preventing slit, whereas the slit can be formed reliably in the joint plate even in this case if the semifinished plate has the structure described in par. 1).

With the semifinished joint plate according to par. 6), an increased spacing can be provided between the inlet portion and the outlet portion, rendering the slit more easy to make.

The front-to-rear length required is shorter in the case of the joint plate according to pars. 7) and 8), with the result that there is a need to decrease the spacing between the inlet portion and the outlet portion and to reduce the front-to-rear width of the short slit. Even in this case, the short circuit preventing slit can be formed in the joint plate. In heat exchangers wherein this joint plate is used, therefore, the short-circuiting between the inlet header and the outlet header can be prevented reliably, obviating the likelihood that the refrigerant flowing into the inlet header from the inlet will enter the outlet header without passing through the refrigerant circulating passage. As a result, the whole refrigerant normally contributes to heat exchange, whereby the impairment of heat exchange performance is avoidable. Having an integral structure, the joint plate can be incorporated, free of impairment of efficiency, into the heat exchanger to be fabricated without increasing the number of components.

In the case where the front-to-rear width of the slit is up to 1 mm after adjustment as in the joint plate according to par. 9), it is impossible to form the slit by usual means such as a press or cutter after determining the front-to-rear length of the joint plate, Even in this case, the short circuit preventing slit can be formed reliably if the joint plate has the structure according to par. 7) or 8).

The joint plate described in par. 7) can be fabricated relatively easily by the process described in par. 10). The refrigerant inlet bulging portion and the refrigerant outlet bulging portion projecting in the same direction and each in the form of a short hollow cylinder having a closed top wall are formed by drawing a metal plate before the upwardly or downwardly extending slit and the slit width adjusting through holes, so that the bulging portions can be given improved dimensional accuracy even when these portions are made by the drawing method which is difficult to perform. If the blank is stamped out from a metal plate first, and the blank is drawn after forming the slit and adjusting portions, the flow of the material becomes impaired at the portions of the slit and adjusting portions, entailing the likelihood of lowering the dimensional accuracy of the bulging portions.

The joint plate can be fabricated relatively easily by the process described in par. 11).

With the heat exchanger according to pars. 12) to 14), the short-circuiting between the inlet header and the outlet header can be prevented reliably, obviating the likelihood that the refrigerant flowing into the inlet header from the inlet will enter the outlet header without passing through the refrigerant circulating passage. As a result, the whole refrigerant normally contributes to heat exchange, whereby the impairment of heat exchange performance is avoidable. Having an integral structure, the joint plate can be incorporated, free of impairment of efficiency, into the heat exchanger to be fabricated without increasing the number of components.

In incorporating the joint plate into the heat exchanger of par. 15) to be fabricated, the joint plate can be positioned in place easily by bringing the bent portion of the joint plate above the upper slit width adjusting portion and the bent portion thereof below the lower slit width adjusting portion into engagement with the respective engaging portions provided between the inlet header and the outlet header.

With the heat exchanger according to par. 16), the separating means functions to give improved uniformity to all the heat exchange tubes joined to the inlet header in the quantities of refrigerant flowing therethrough, further rendering all the heat exchange tubes joined to the outlet header uniform in the quantities of refrigerant flowing therethrough and enabling the exchanger to achieve a further improved heat exchange efficiency.

BEST MODE OF CARRYING OUT THE INVENTION

Embodiments of the present invention will be described below with reference to the drawings. The embodiments are heat exchangers of the invention for use as evaporators in motor vehicle air conditioners.

Figure 1:
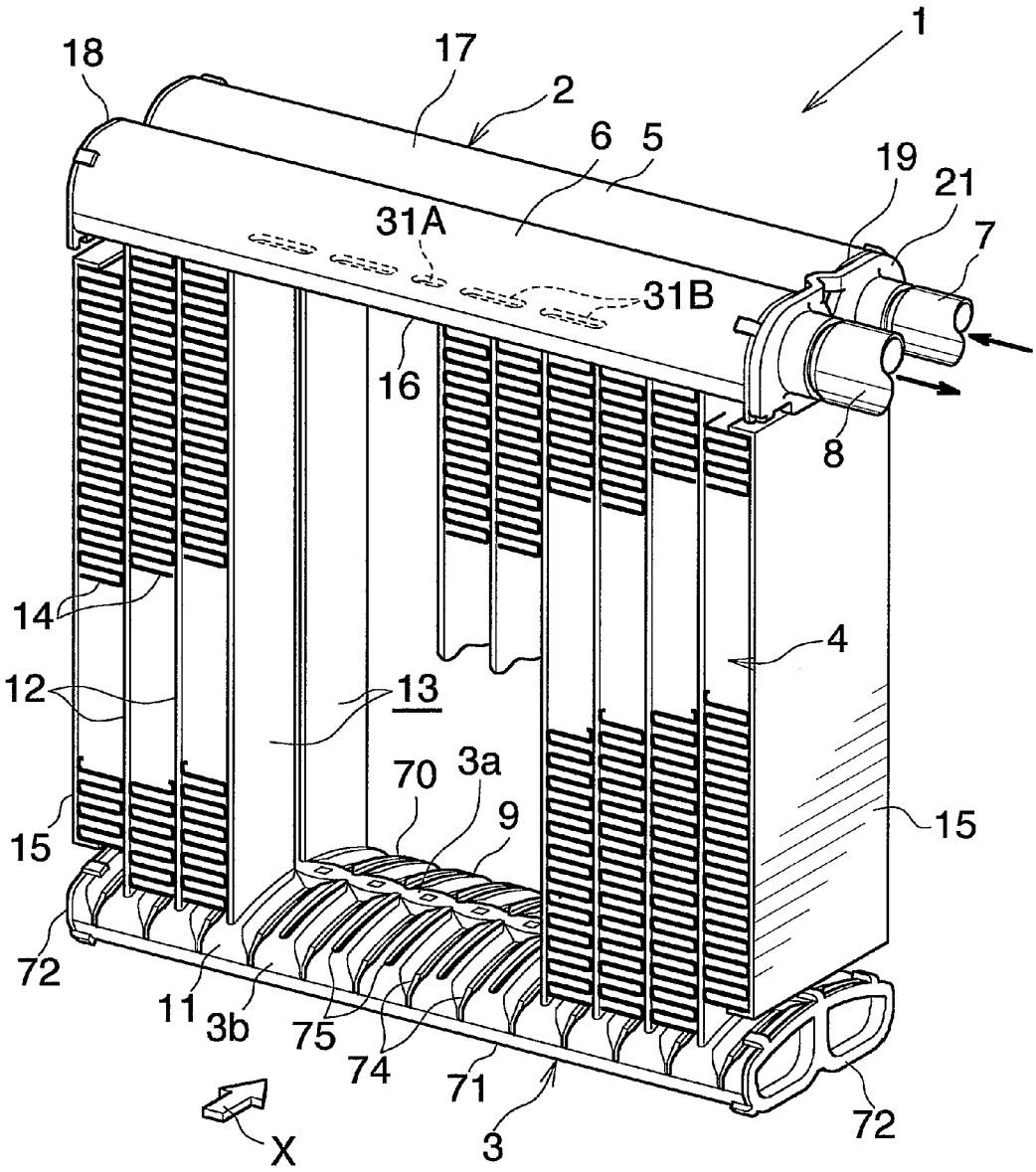
FIG. 1 is a perspective view partly broken away and showing the overall construction of an evaporator to which a heat exchanger of the invention is applied.
Figure 2:
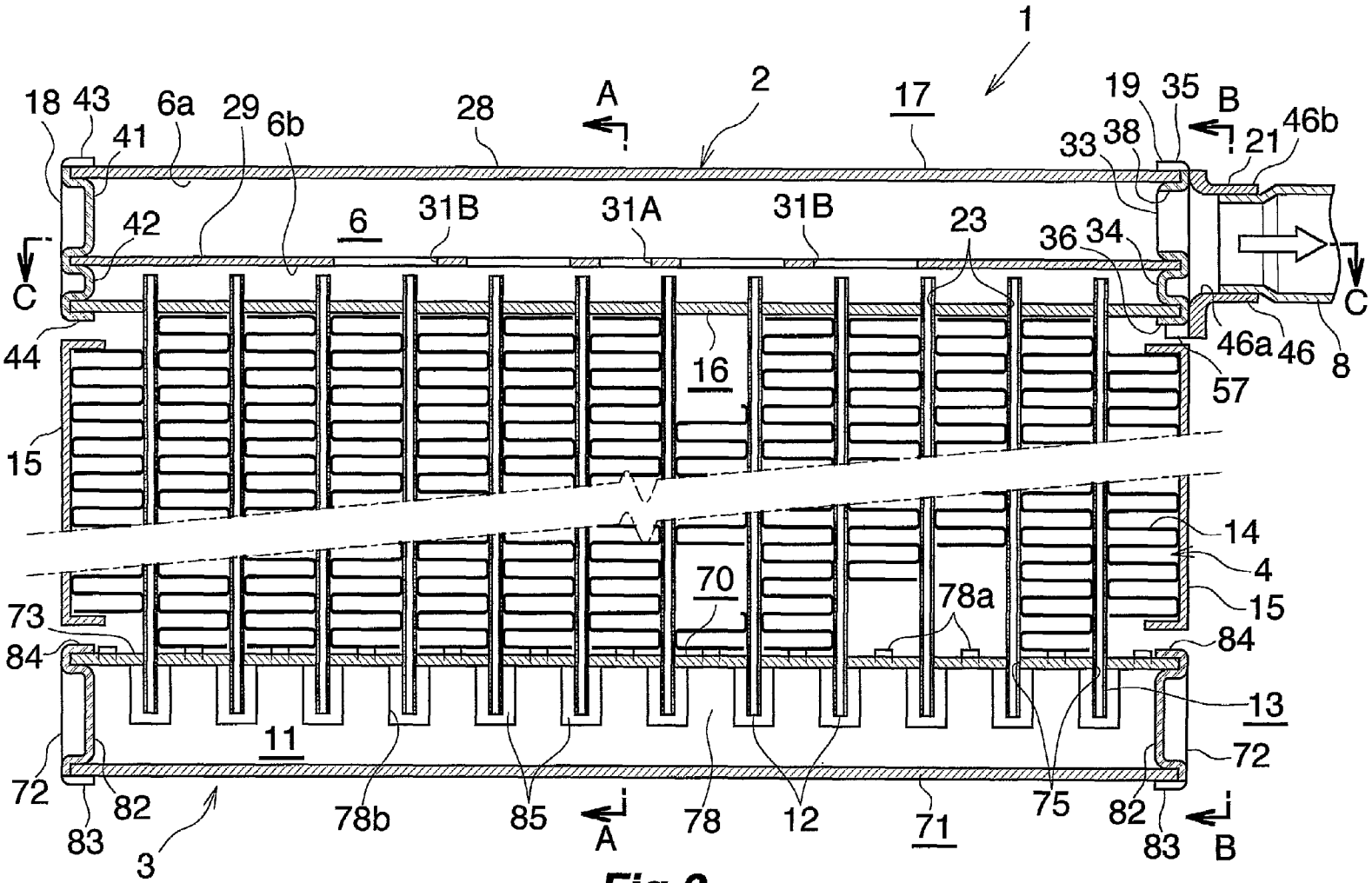
FIG. 2 is a view in vertical section and showing the evaporator of FIG. 1 with an intermediate portion omitted.
Figure 3:
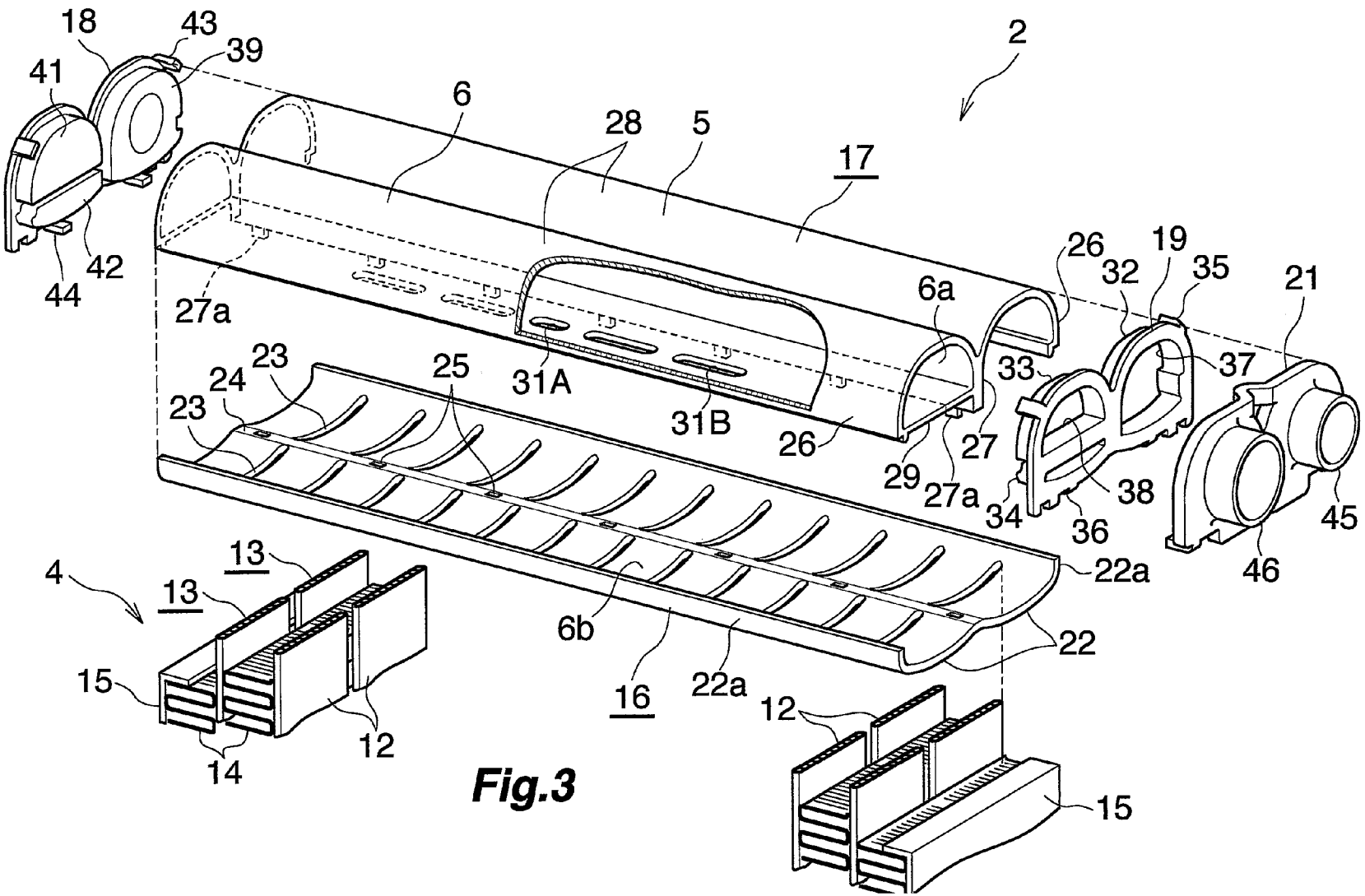
FIG. 3 is an exploded perspective view of a refrigerant inlet-outlet tank of the evaporator of FIG. 1.
Figure 8:
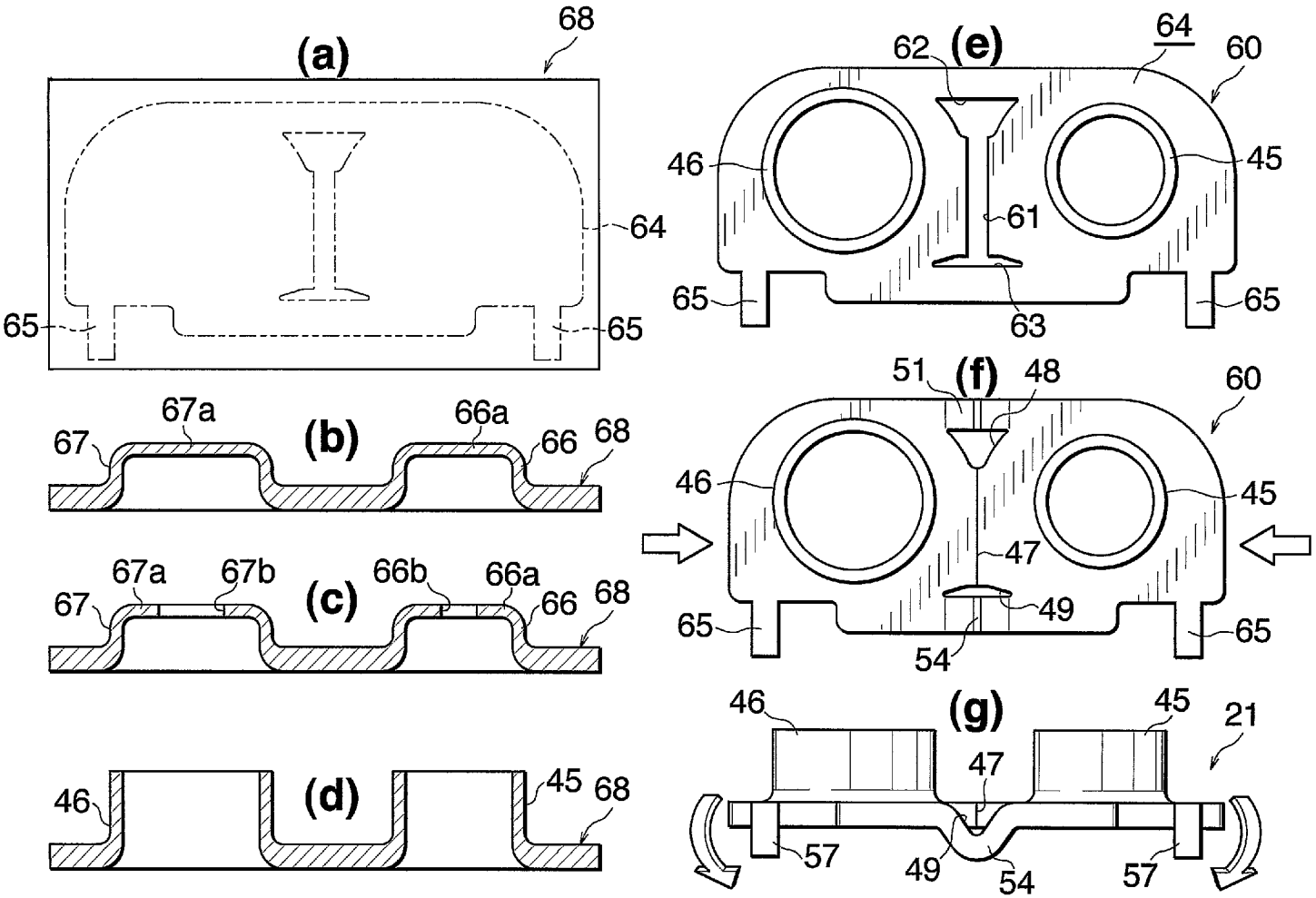
FIG. 8 is a diagram showing stepwise a process for fabricating the joint plate.

FIGS. 1 and 2 show the overall construction of a motor vehicle air conditioner evaporator to which the heat exchanger of the invention is applied, FIGS. 3 to 7 and 9 show the constructions of main parts, and FIG. 8 shows a process for fabricating a joint plate. Further FIG. 10 shows how a refrigerant flows through the evaporator.

FIGS. 1 and 2 show an evaporator 1 for use in motor vehicle air conditioners wherein a chlorofluorocarbon refrigerant is used. The evaporator 1 comprises a refrigerant inlet-outlet tank 2 of aluminum and a refrigerant turn tank 3 of aluminum which are arranged as vertically spaced apart, and a heat exchange core 4 provided between the two tanks 2, 3.

The refrigerant inlet-outlet tank 2 comprises a refrigerant inlet header 5 positioned on the front side (the downstream side with respect to the direction of flow of air through the evaporator), and a refrigerant outlet header 6 positioned on the rear side (the upstream side with respect to the flow of air). A refrigerant inlet pipe 7 of aluminum is connected to the inlet header 5 of the tank 2, and a refrigerant outlet pipe 8 of aluminum to the outlet header 6 of the tank. The refrigerant turn tank 3 comprises a refrigerant inflow header 9 positioned on the front side, and a refrigerant outflow header 11 positioned on the rear side.

The heat exchange core 4 comprises tube groups 13 in the form of a plurality of rows, i.e., two rows in the present embodiment, as arranged in the front-rear direction, each tube group 13 comprising a plurality of heat exchange tubes 12 arranged in parallel in the left-right direction at a spacing. Corrugated fins 14 are arranged respectively in air passing clearances between respective adjacent pairs of heat exchange tubes 12 of each tube group 13 and also outside the heat exchange tubes 12 at the left and right opposite ends of each tube group 13, and are each brazed to the heat exchange tube 9 adjacent thereto. An aluminum side plate 15 is disposed outside the corrugated fin 14 at each of the left and right ends and brazed to the fin 14. The heat exchange tubes 12 of the front tube group 13 have upper and lower ends joined respectively to the inlet header 5 and the inflow header 9, and the heat exchange tubes 12 of the rear tube group 13 have upper and lower ends joined respectively to the outlet header 6 and the outflow header 11. The inflow header 9, the outflow header 11 and all heat exchange tubes 12 constitute a refrigerant circulating passage for causing the inlet header 5 to communicate with the outlet header 6.

With reference to FIGS. 3 to 7, the refrigerant inlet-outlet tank 2 comprises a platelike first member 16 made of an aluminum brazing sheet having a brazing material layer over opposite surfaces thereof and having the heat exchange tubes 12 joined thereto, a second member 17 of bare aluminum extrudate and covering the upper side of the first member 16, and aluminum caps 18, 19 made of an aluminum brazing sheet having a brazing material layer over opposite surfaces there and joined to opposite ends of the two members 16, 17 for closing the respective opposite end openings. An aluminum joint plate 21 elongated in the front-rear direction is brazed to the outer surface of the cap 19 at the right end so as to cover both the inlet header 5 and the outlet header 6. The refrigerant inlet and outlet pipes 7, 8 are joined to the joint plate 21.

The first member 16 has at each of the front and rear side portions thereof a curved portion 22 in the form of a circular arc of small curvature in cross section and bulging downward at its midportion. The curved portion 22 has a plurality of tube insertion slits 23 elongated in the front-rear direction and arranged at a spacing in the left-right, i.e., lateral, direction. Each corresponding pair of slits 23 in the front and rear curved portions 22 are in the same position with respect to the lateral direction. The front edge of the front curved portion 22 and the rear edge of the rear curved portion 22 are integrally provided with respective upstanding walls 22*a* extending over the entire length of the member 16. The first member 16 includes between the two curved portions 22 a flat portion 24 having a plurality of through holes 25 arranged at a spacing in the lateral direction.

The second member 17 is generally m-shaped in cross section and opened downward and comprises front and rear two walls 26 extending laterally, a partition wall 27 provided in the midportion between the two walls 26 and extending laterally as separating means for dividing the interior of the refrigerant inlet-outlet tank 2 into front and rear two spaces, and two generally circular-arc connecting walls 28 bulging upward and integrally connecting the partition wall 27 to the respective front and rear walls 26 at their upper ends. The rear wall 26 and the partition wall 27 are integrally interconnected at their lower ends over the entire length of the member 17 by a flow dividing resistance plate 29 serving as separating means for dividing the interior of the outlet header 6 into upper and lower spaces 6*a*, 6*b* as arranged in the direction of height. The resistance plate 29 has refrigerant passing through holes 31A, 31B elongated laterally, formed therein at a rear portion thereof other than the left and right end portions of the plate and arranged at a spacing laterally thereof. The partition wall 27 has a lower end projecting downward beyond the lower ends of the front and rear walls 26 and is integrally provided with a plurality of projections 27*a* projecting downward from the lower edge of the wall 27, arranged at a spacing in the lateral direction and fitted into the throughholes 25 of the first member 16. The projections 27*a* are formed by cutting away specified portions of the partition wall 27.

The right cap 19 is integrally provided, on the left side of its front portion, with a leftward protrusion 32 to be fitted into the inlet header 5. The cap 19 is integrally provided, on the left side of its rear portion, with an upper leftward protrusion 33 to be fitted into the upper space 6*a* of the outlet header 6 above the resistance plate 29 and with a lower leftward protrusion 34 positioned below and spaced apart from the protrusion 33 and to be fitted into the lower space 6*b* of the header 6 under the plate 29. The right cap 19 has an engaging lug 35 projecting leftward and formed integrally therewith on a circular-arc portion between its upper edge and each of the front and rear side edges thereof. The right cap 19 further has an engaging lug 36 projecting leftward and formed integrally therewith on each of front and rear portions of its lower edge. A refrigerant inlet 37 is formed in the bottom wall of the leftward protrusion 32 of the front portion of the right cap 19. A refrigerant outlet 38 is formed in the bottom wall of the upper leftward protrusion 33 of the rear portion of the right cap 19. The left cap 18 is symmetric to the right cap 19. The left cap 18 has formed integrally therewith a rightward protrusion 39 fittable into the inlet header 5, an upper rightward protrusion 41 fittable into the upper space 6*a* of the outlet header 6 above the resistance plate 29, a lower rightward protrusion 42 fittable into the lower space 6*b* of the header 6 below the resistance plate 29, and upper and lower engaging lugs 43, 44 projecting rightward. No opening is formed in the bottom walls of the rightward protrusion 39 and the upper rightward protrusion 41. The two caps 18, 19 each have an upper edge comprising two generally circular-arc front and rear portions joined to each other in alignment by a midportion so as to conform in shape to the shape of the inlet-outlet tank second member 17. The two caps 18, 19 each have a lower edge comprising two generally circular-arc front and rear portions joined to each other in alignment by a middle flat portion so as to conform in shape to the shape of the inlet-outlet tank first member 16.

The joint plate 21 has a short cylindrical refrigerant inlet 45 (refrigerant inlet portion) communicating with the inlet 37 of the right cap 19, and a short cylindrical refrigerant outlet 46 (refrigerant outlet portion) communicating with the outlet 38 of the cap. The inlet 45 and the outlet 46 comprise circular through holes 45*a*, 46*a*, and short cylinders 45*b*, 46*b* projecting rightward and formed around the holes 45*a*, 46*a*, respectively, integrally with the joint plate. The center of the inlet 45 is at the same level as that of the outlet 46. The short cylinder 45*b* of the inlet 45 is smaller than short cylinder 46*b* of the outlet 46 in outside diameter. The joint plate 21 is preferably up to 50 mm in front-to-rear length, and the spacing between the inlet 45 and the outlet 46 is preferably 6 to 9 mm.

Formed in the portion of the joint plate 21 between the inlet 45 and the outlet 46 are a vertically extending slit 47 for preventing a short circuit and generally triangular through holes 48, 49 communicating respectively with the upper and lower ends of the slit 47. The slit 47 has a width of preferably up to 1 mm in the front-rear direction. The joint plate 21 has bent portions 51, 54 formed above the upper hole 48 and below the lower hole 49, respectively, and projecting leftward. The upper bent portion 51 is in engagement with engaging portions provided between the inlet header 5 and the outlet header 6, i.e., an engaging portion 52 formed on the upper edge of the right cap 19 between the two generally circular-arc portions thereof, and an engaging portion 53 provided between the two connecting walls 28 of the second ember 17 of the inlet-outlet tank 2. The lower bent portion 54 is in engagement with engaging portions provided between the inlet header 5 and the outlet header 6, i.e., an engaging portion 55 provided by the above-mentioned flat portion formed on the lower edge of the right cap 19 between the two generally circular-arc portions thereof, and an engaging portion 56 comprising the flat portion 24 of the first member 16 of the inlet-outlet tank 2. The joint plate 21 further has engaging lugs 57 projecting leftward and formed integrally with the lower edge thereof respectively at its front and rear ends. The lugs 57 are engaged with the right cap 19, as fitted in recesses 19*a* formed in the lower edge of the cap 19.

The joint plate 21 is made from a semifinished joint plate 60 as shown in FIG. 8(*e*). The semifinished plate 60 has a refrigerant inlet 45 and a refrigerant outlet 46 spaced apart in the front-rear direction, a slit 61 having a large width, formed in a portion between the inlet 45 and the outlet 46 and extending upward or downward, and slit width adjusting portions 62, 63 each in the form of a generally triangular through hole and having a width increasing as the adjusting portion extends away from the slit 61 so as to communicate respectively with the upper and lower ends of the slit 61. The semifinished plate 60 has a larger length in the front-rear direction than the joint plate 21.

The joint plate 21 is fabricated by the process to be described in greater detail with reference to FIG. 8.

A metal plate, i.e., an aluminum plate 68 in the present embodiment, is prepared first [see FIG. 8(*a*)], and the aluminum plate 68 is drawn to form a refrigerant inlet bulging portion 66 and a refrigerant outlet bulging portion 67 each in the form of a short hollow cylinder having a closed top wall [see FIG. 8(*b*)]. Through holes 66*b*, 67*b* are then formed in the top walls 66*a*, 67*a* of the respective bulging portions 66, 67 centrally thereof [see FIG. 8(*c*)], and top wall portions defining the through holes 66*b*, 67*b* are thereafter raised outward by burring to make upright portions and form an inlet 45 and an outlet 46 [see FIG. 8(*d*)].

A blank 64 of specified shape is subsequently stamped out by subjecting the aluminum plate to press work, an upwardly or downwardly extending slit 61 is formed in a portion of the blank 64 between the inlet 45 and the outlet 46, and slit width adjusting portions 62, 63 each in the form of a generally triangular through hole and having a width increasing as the adjusting portion extends away from the slit 61 are formed in the blank in communication with the respective upper and lower ends of the slit 61. At the same time, engaging lug downward projections 65 projecting downward are formed at the front and rear ends of lower edge of the blank 64. In this way, a semifinished joint plate 60 is made [see FIG. 8(*e*)].

Subsequently, a portion of the semifinished plate 60 above the upper through hole 62 and a portion thereof below the lower through hole 63 are bent in a direction opposite to the direction of projection of the inlet 45 and the outlet 46, i.e., leftward, while pressing the semifinished plate from the front and rear to form bent portions 51, 54, thereby shorten the plate 60 in the front-rear direction and decrease the width of the slit 61 in the front-rear direction for adjustment, whereby a short circuit preventing slit 47 is formed [see FIG. 8(*f*)]. Through holes 48, 49 are provided by the two slit width adjusting portions 62, 63. Finally, the engaging lug downward projections 65 are bent leftward to form engaging lugs 57 [see FIG. 8(*g*)]. In this way, a joint plate 21 is fabricated.

The engaging lugs 57 may be formed by bending the downward projections 63 at any stage after the blank 64 is stamped out.

A constricted portion 7*a* formed at one end of the inlet pipe 7 is inserted in and brazed to the inlet 45 of the joint plate 21, and a constricted portion 8*a* formed at one end of the outlet pipe 8 is inserted in and brazed to the outlet 46, 46 of the member 21. Although not shown, an expansion valve mount member is provided on both the other ends of the inlet pipe 7 and the outlet pipe 8 across both of these pipes.

The first and second members 16, 17 of the refrigerant inlet-outlet tank 2, the two caps 18, 19 and the joint plate 21 are brazed together in the following manner. The first and second members 16, 17 are brazed to each other utilizing the brazing material layer of the first member 16, with the projections 27*a* of the second member 17 inserted through the respective through holes 25 of the first member 16 in crimping engagement therewith and with the upper ends of the front and rear upstanding walls 22*a* of the first member 16 thereby engaged with the lower ends of the front and rear walls 26 of the second member 17. The two caps 18, 19 are brazed to the first and second members 16, 17 utilizing the brazing material layers of the caps 18, 19, with the protrusions 39, 32 of the front portions fitting in the front space inside the two members 16, 17 forwardly of the partition wall 27, with the upper protrusions 41, 33 of the rear portions fitting in the upper space inside the two members 16, 17 rearwardly of the partition wall 27 and above the resistance plate 29, with the lower protrusions 42, 34 of the rear portions fitting in the lower space rearwardly of the partition wall 27 and below the resistance plate 29, with the upper engaging lugs 43, 35 engaged with the connecting walls 28 of the second member 17, and with the lower engaging lugs 44, 36 engaged with the curved portions 22 of the first member 16. The joint plate 21 is brazed to the right cap 19 utilizing the brazing material layer of the cap 19, with the upper bent portion 51 engaged in the upper engaging portion 52 of the cap 19 and in the engaging portion 53 of the second member 17, with the lower bent portion 54 engaged with the lower engaging portion 55 of the cap 19 and with the engaging portion 56 of the first member 16, and with the engaging lugs 57 engaged in the recesses 19*a* formed in the lower edge of the cap 19.

In this way, the refrigerant inlet-outlet tank 2 is made. The portion of the second member 17 forwardly of the partition wall 27 serves as the inlet header 2, and the portion of the member 17 rearward of the partition wall 27 as the outlet header 6. The outlet header 6 is divided by the flow dividing resistance plate 29 into upper and lower spaces 6*a*, 6*b*, which are held in communication by the refrigerant passing holes 31A, 31B. The refrigerant outlet 38 of the right cap 19 is in communication with the upper space 6*a* of the outlet header 6. The refrigerant inlet 45 of the joint plate 21 communicates with the refrigerant inlet 37, and the refrigerant outlet 46 thereof communicates with the outlet 38.

Figure 4:
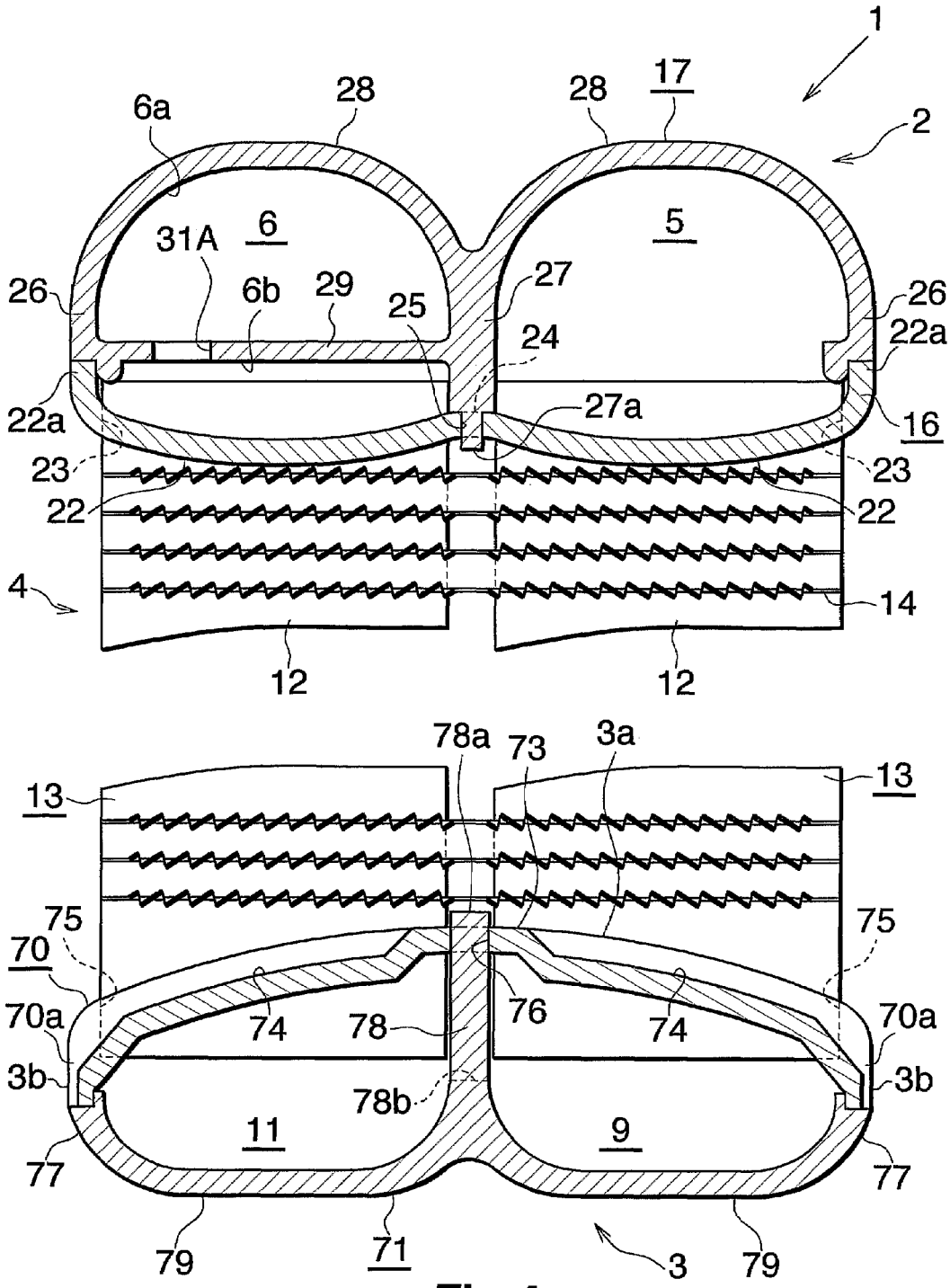
FIG. 4 is an enlarged fragmentary view in section taken along the line A-A in FIG. 2.
Figure 5:
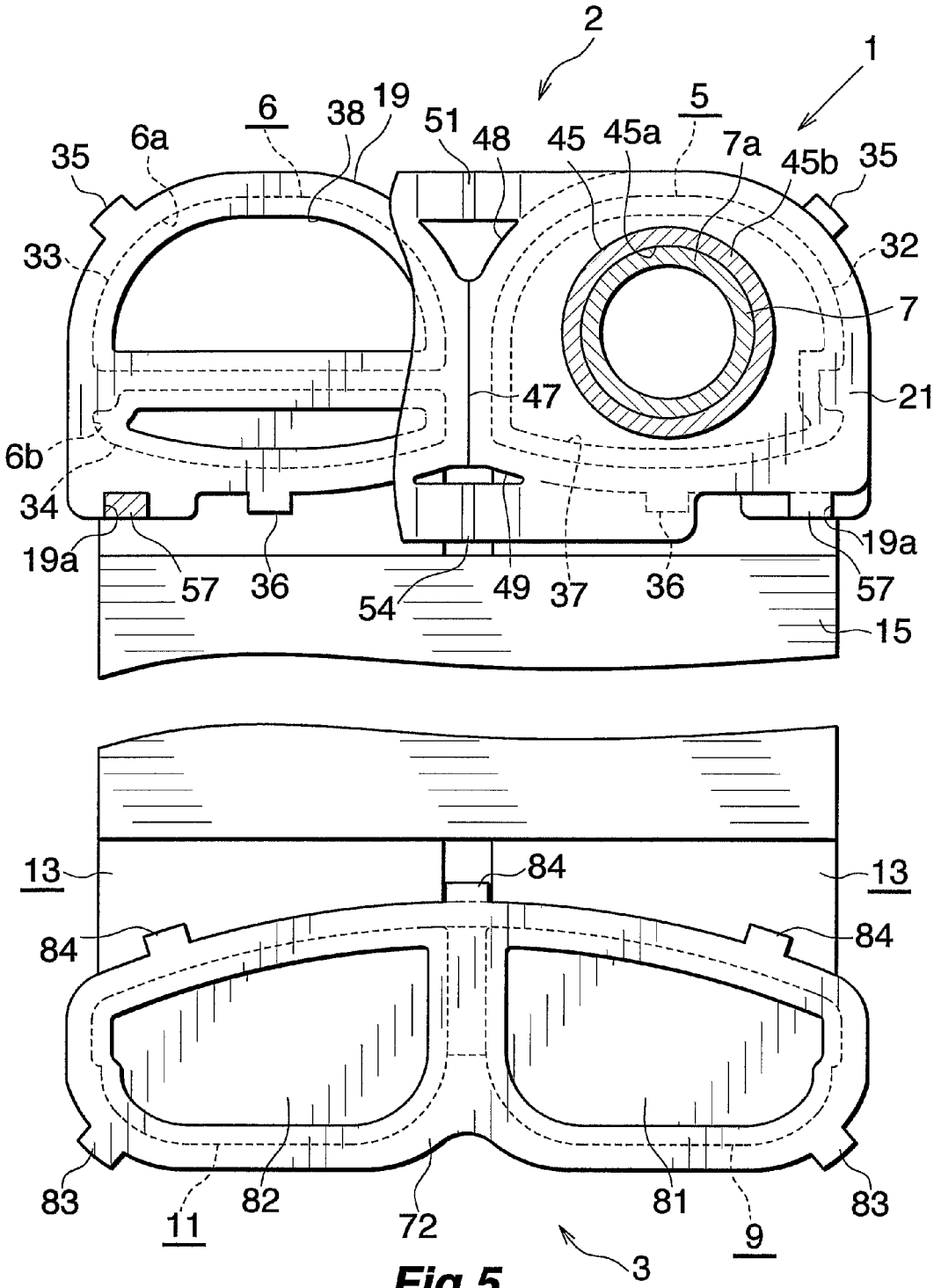
FIG. 5 is an enlarged fragmentary view in section taken along the line B-B in FIG. 2.
Figure 6:
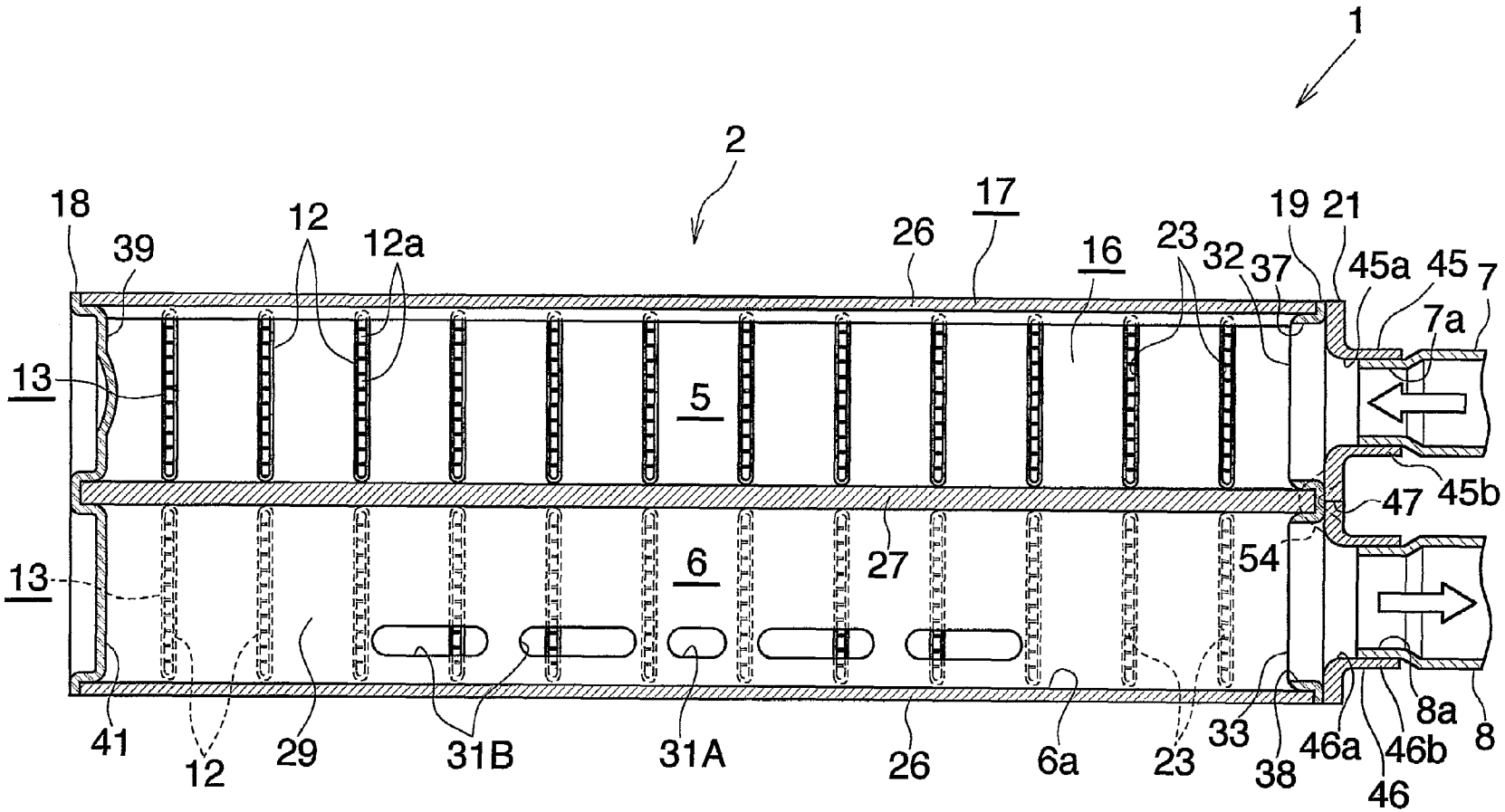
FIG. 6 is a view in section taken along the line C-C in FIG. 2.
Figure 7:
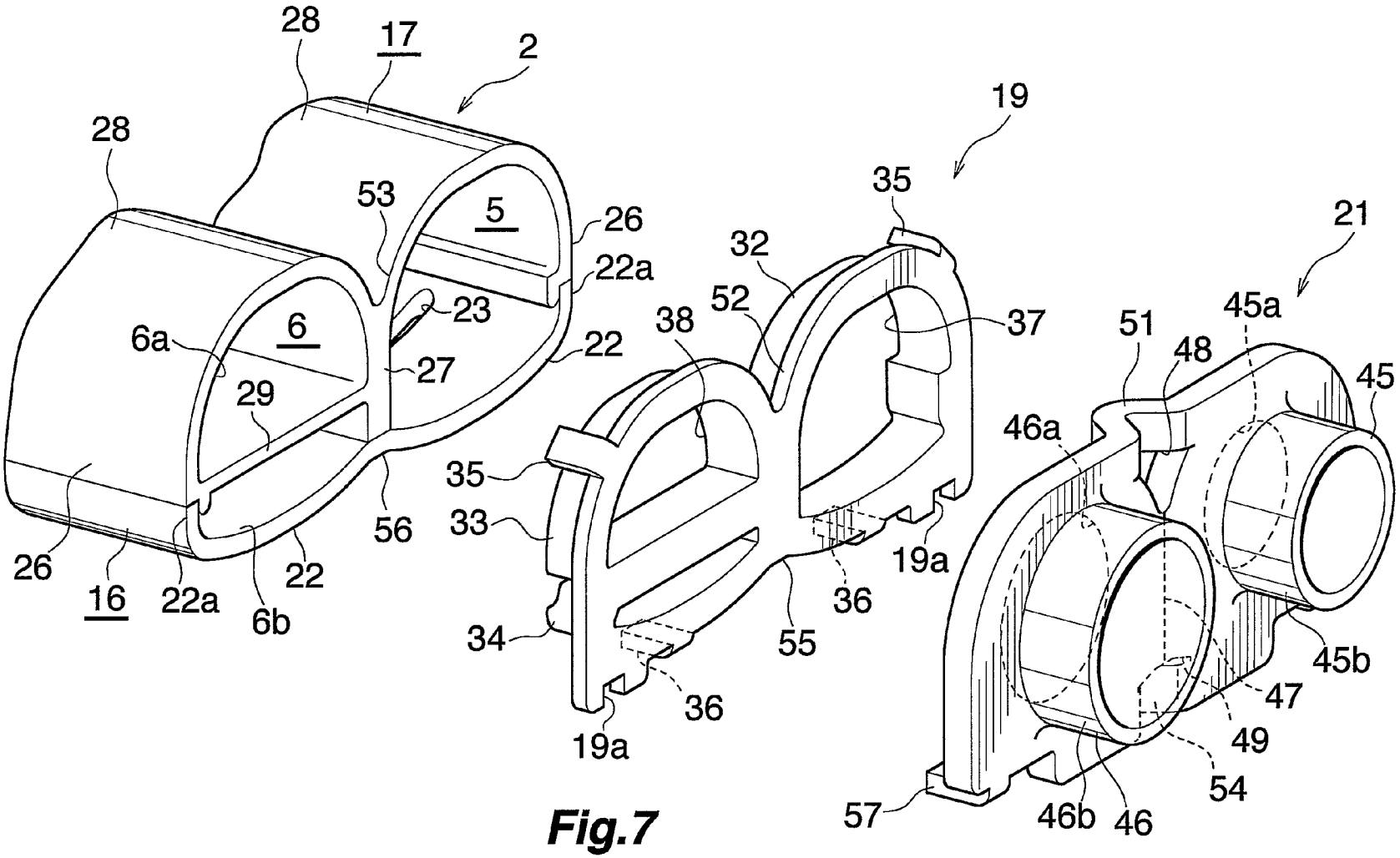
FIG. 7 is an exploded perspective view showing the inlet-outlet tank, a right cap and a joint plate of the evaporator of FIG. 1.
Figure 9:
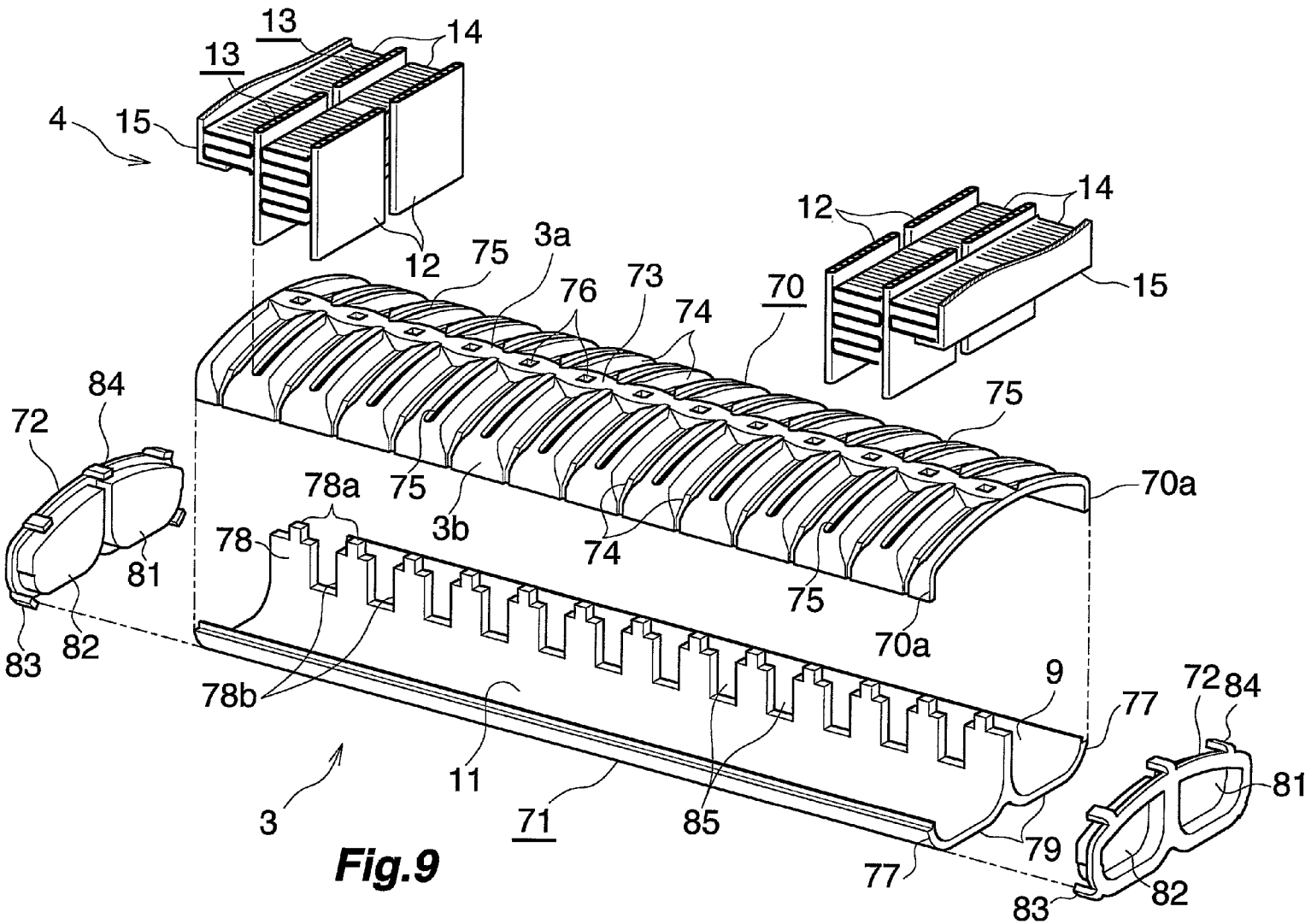
FIG. 9 is an exploded perspective view of a refrigerant turn tank of the evaporator of FIG. 1.
Figure 10:
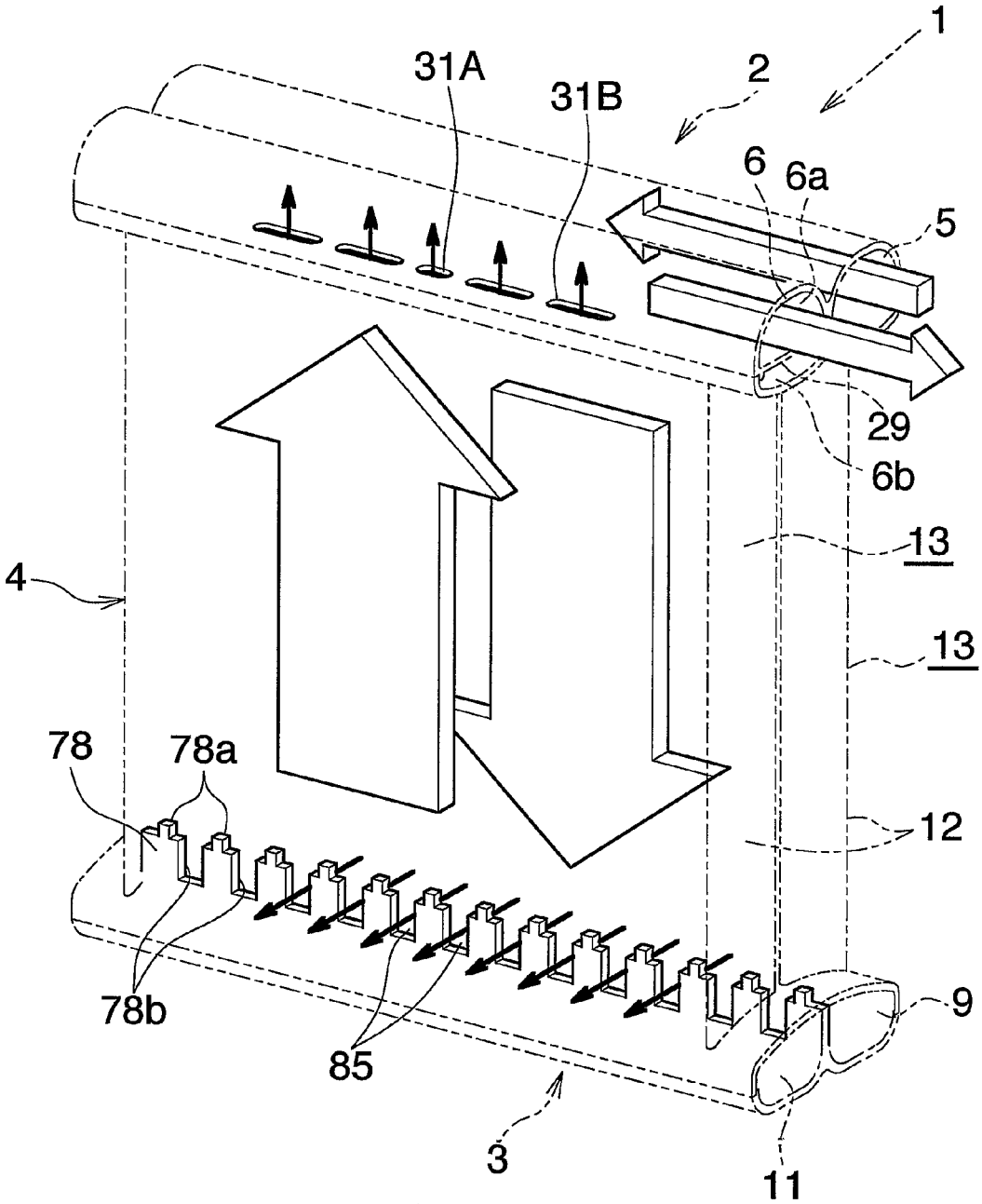
FIG. 10 is a diagram showing how a refrigerant flows through the evaporator.

With reference to FIGS. 4 and 9, the refrigerant turn tank 3 comprises a platelike first member 70 made of aluminum brazing sheet having a brazing material layer over opposite surfaces thereof and having the heat exchange tubes 12 joined thereto, a second member 71 made of bare aluminum extrudate and covering the lower side of the first member 70, and aluminum caps 72 made of aluminum brazing sheet having a brazing material layer over opposite surfaces thereof for closing left and right opposite end openings.

The refrigerant turn tank 3 has a top surface 3*a* which is in the form of a circular-arc in cross section in its entirety such that the midportion thereof with respect to the front-rear direction is the highest portion 73 which is gradually lowered toward the front and rear sides. The tank 3 is provided in its front and rear opposite side portions with grooves 74 extending from the front and rear opposite sides of the highest portion 73 of the top surface 3*a* to front and rear opposite side surfaces 3*b*, respectively, and arranged laterally at a spacing.

The first member 70 has a circular-arc cross section bulging upward at its midportion with respect to the front-rear direction and is provided with a depending wall 70*a* formed at each of the front and rear side edges thereof integrally therewith and extending over the entire length of the member 70. The upper surface of the first member 70 serves as the top surface 3*a* of the refrigerant turn tank 3, and the outer surface of the depending wall 70*a* as the front or rear side surface 3*b* of the tank 3. The grooves 74 are formed in each of the front and rear side portions of the first member 70 and extend from the highest portion 73 in the midportion of the member 70 with respect to the front-rear direction to the lower end of the depending wall 70*a*. In each of the front and rear side portions of the first member 70 other than the highest portion 73 in the midportion thereof, tube insertion slits 75 elongated in the front-rear direction are formed between respective adjacent pairs of grooves 74. Each corresponding pair of front and rear tube insertion slits 75 are in the same position with respect to the lateral direction. The first member 70 has a plurality of through holes 76 formed in the highest portion 73 in the midportion thereof and arranged laterally at a spacing. The depending walls 70*a*, grooves 74, tube insertions slits 75 and through holes 76 of the first member 70 are formed at the same time by making the member 70 from an aluminum brazing sheet by press work.

The second member 71 is generally w-shaped in cross section and opened upward, and comprises front and rear two walls 77 curved upwardly outwardly forward and rearward, respectively, and extending laterally, a vertical partition wall 78, provided at the midportion between the two walls 77, extending laterally and serving as separating means for dividing the interior of the refrigerant turn tank 3 into front and rear two spaces, and two connecting walls 79 integrally connecting the partition wall 78 to the respective front and rear walls 77 at their lower ends. The partition wall 78 has an upper end projecting upward beyond the upper ends of the front and rear walls 77 and is provided with a plurality of projections 78*a* projecting upward from the upper edge thereof integrally therewith, arranged laterally at a spacing and fitted into the respective through holes 76 in the first member 70. The partition wall 78 is provided with refrigerant passing cutouts 78*b* formed in its upper edge between respective adjacent pairs of projections 78*a*. The projections 78*a* and the cutouts 78*b* are formed by cutting away specified portions of the partition wall 78.

The second member 71 is produced by extruding the front and rear walls 77, partition wall 78 and connecting walls 79 integrally, and cutting the partition wall 78 to form the projections 78*a* and cutouts 78*b*.

The front portion of each of the caps 72 has a laterally inward protrusion 81 formed on the laterally inner side thereof integrally therewith and fittable into the inflow header 9. The rear portion of the cap 72 has a laterally inward protrusion 82 formed on the laterally inner side thereof integrally therewith and fittable into the outflow header 11. Each cap 72 is integrally provided at a circular-arc portion between the lower edge thereof and each of the front and rear side edges thereof with an engaging lug 83 projecting laterally inward, and further has a plurality of engaging lugs 84 arranged at a spacing in the front-rear direction, formed on its upper edge integrally therewith and projecting laterally inward.

The first and second members 70, 71 of the turn tank 3 and the two caps 72 thereof are brazed together in the following manner. The first and second members 70, 71 are brazed to each other utilizing the brazing material layer of the first member 70, with the projections 78*a* of the second member 71 inserted through the respective holes 76 in crimping engagement and with the lower ends of front and rear depending walls 70*a* of the first member 70 in engagement with the upper ends of front and rear walls 77 of the second member 71. The two caps 72 are brazed to the first and second members 70, 71 using the brazing material layers of the caps 72, with the front protrusions 81 fitted in the space defined by the two members 70, 71 and positioned forwardly of the partition wall 78, with the rear protrusions 82 fitted in the space defined by the two members 70, 71 and positioned rearwardly of the partition wall 78, with the upper engaging lugs 84 engaged with the first member 70 and with the lower engaging lugs 83 engaged with the front and rear walls 77 of the second member 71. In this way, the refrigerant turn tank 3 is formed. The portion of the second member 71 forwardly of the partition wall 78 serves as the inflow header 9, and the portion thereof rearwardly of the partition wall 78 as the outflow header 11. The upper-end openings of the cutouts 78*b* in the partition wall 78 of the second member 71 are closed with the first member 70, whereby refrigerant passing holes 85 are formed.

The heat exchange tubes 12 providing the front and rear tube groups 13 are each made of aluminum extrudate. Each tube 12 is flat, has a large width in the front-rear direction and is provided in its interior with a plurality of refrigerant channels 12*a* extending longitudinally of the tube and arranged in parallel (see FIG. 6). The tubes 12 have upper end portions inserted through the slits 23 in the first member 16 of the refrigerant inlet-outlet tank 2 and are brazed to the first member 16 utilizing the brazing material layer of the member 16. The tubes 12 have lower end portions inserted through the slits 75 in the first member 70 of the refrigerant turn tank 3 and are brazed to the first member 70 utilizing the brazing material layer of the member 70.

Preferably, the heat exchange tube 12 is 0.75 to 1.5 mm in height, i.e., in thickness in the lateral direction, 12 to 18 mm in width in the front-rear direction, 0.175 to 0.275 mm in the wall thickness of the peripheral wall thereof, 0.175 to 0.275 mm in the thickness of partition walls separating refrigerant channels from one another, 0.5 to 3.0 mm in the pitch of partition walls, and 0.35 to 0.75 mm in the radius of curvature of the outer surfaces of the front and rear opposite end walls.

In place of the heat exchange tube 12 of aluminum extrudate, an electric resistance welded tube of aluminum may be used which has a plurality of refrigerant channels formed therein by inserting inner fins into the tube. Also usable is a tube which is made from a plate prepared from an aluminum brazing sheet having an aluminum brazing material layer one surface thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof, by bending the plate into the shape of a hairpin at the connecting portion and brazing the side wall forming portions to each other in butting relation to form partition walls by the partition forming portions.

The corrugated fin 14 is made from an aluminum brazing sheet having a brazing material layer on opposite sides thereof by shaping the sheet into a wavy form. Louvers are formed as arranged in parallel in the front-rear direction in the portions of the wavy sheet which connect crest portions thereof to furrow portions thereof. The corrugated fins 14 are used in common for the front and rear tube groups 13. The width of the fin 14 in the front-rear direction is approximately equal to the distance from the front edge of the heat exchange tube 12 in the front tube group 13 to the rear edge of the corresponding heat exchange tube 12 in the rear tube group 13. It is desired that the corrugated fin 14 be 7.0 mm to 10.0 mm in fin height, i.e., the straight distance from the crest portion to the furrow portion, and 1.3 to 1.8 mm in fin pitch, i.e., the pitch of connecting portions. Instead of one corrugated fin serving for both the front and rear tube groups 13 in common, a corrugated fin may be provided between each adjacent pair of heat exchange tubes 12 of each tube group 13.

The evaporator 1 is fabricated by tacking the components, other than the refrigerant inlet pipe 7 and outlet pipe 8, in combination and brazing the tacked assembly collectively.

Along with a compressor and a condenser, the evaporator 1 constitutes a refrigeration cycle, which is installed in vehicles, for example, in motor vehicles for use as an air conditioner.

With reference to FIG. 10 showing the evaporator 1 described, a two-layer refrigerant of vapor-liquid mixture phase flowing through a compressor, condenser and expansion valve enters the refrigerant inlet header 5 of the inlet-outlet tank 2 via the refrigerant inlet pipe 7, the refrigerant inlet portion 45 of the joint plate 21 and the refrigerant inlet 37 of the right cap 19 and dividedly flows into the refrigerant channels 12*a* of all the heat exchange tubes 12 of the front tube group 13. When the constricted portion 7*a* of the inlet pipe 7 has an inside diameter of 3 to 8.5 mm, the refrigerant reaches the left end of the inlet header 5 and uniformly flows into all the heat exchange tubes 12 of the front tube group 13 at this time.

The refrigerant flowing into the channels 12*a* of all the heat exchange tubes 12 flows down the channels 12*a*, ingresses into the refrigerant inflow header 9 of the refrigerant turn tank 3. The refrigerant in the header 9 flows through the refrigerant passing holes 85 of the partition wall 78 into the refrigerant outflow header 11.

The refrigerant flowing into the outflow header 11 dividedly flows into the refrigerant channels 12*a* of all the heat exchange tubes 12 of the rear tube group 13, changes its course and passes upward through the channels 12*a* into the lower space 6*b* of the outlet header 6. The resistance given by the flow dividing resistance plate 29 in this header to the flow of refrigerant enables the refrigerant to uniformly flow from the outflow header 11 into all heat exchange tubes 12 of the rear tube group 13 and also to flow from inlet header 5 into all the tubes 12 of the front tube group 13 more uniformly. As a result, the refrigerant flows through all the heat exchange tubes 12 of the two tube groups 13 in uniform quantities.

Subsequently, the refrigerant flows through the refrigerant passing holes 31A, 31B of the resistance plate 29 into the upper space 6*a* of the outlet header 6 and flows out of the evaporator via the refrigerant outlet 38 of the right cap 19, the outlet portion 46 of the joint plate 21 and the outlet pipe 8. While flowing through the refrigerant channels 12*a* of the heat exchange tubes 12 of the front tube group 13 and the refrigerant channels 12*a* of the heat exchange tubes 12 of the rear tube group 13, the refrigerant is subjected to heat exchange with the air flowing through the air passing clearances in the direction of arrow X shown in FIG. 1 and flows out of the evaporator in a vapor phase.

At this time, water condensate is produced on the surfaces of the corrugated fins 14, and the condensate flows down the top surface 3*a* of the turn tank 3. The condensate flowing down the tank top surface 3*a* enters the grooves 74 by virtue of a capillary effect, flows through the grooves 74 and falls off the forwardly or rearwardly outer ends of the grooves 74 to below the turn tank 3. This prevents a large quantity of condensate from collecting between the top surface 3*a* of the turn tank 3 and the lower ends of the corrugated fins 14, consequently preventing the condensate from freezing due to the collection of large quantity of the condensate, whereby inefficient performance of the evaporator 1 is precluded.

One group 13 of heat exchange tubes is provided between the inlet header 5 and the inflow header 9 of the two tanks 2, 3, as well as between the outlet header 6 and the outflow header 11 thereof according to the foregoing embodiment, whereas this arrangement is not limitative; one or at least two groups 13 of heat exchange tubes may be provided between the inlet header 5 and the inflow header 9 of the two tanks 2, 3, as well as between the outlet header 6 and the outflow header 11 thereof. The evaporator may be used with the turn tank 3 positioned above the inlet-outlet tank 2.

Figure 11:
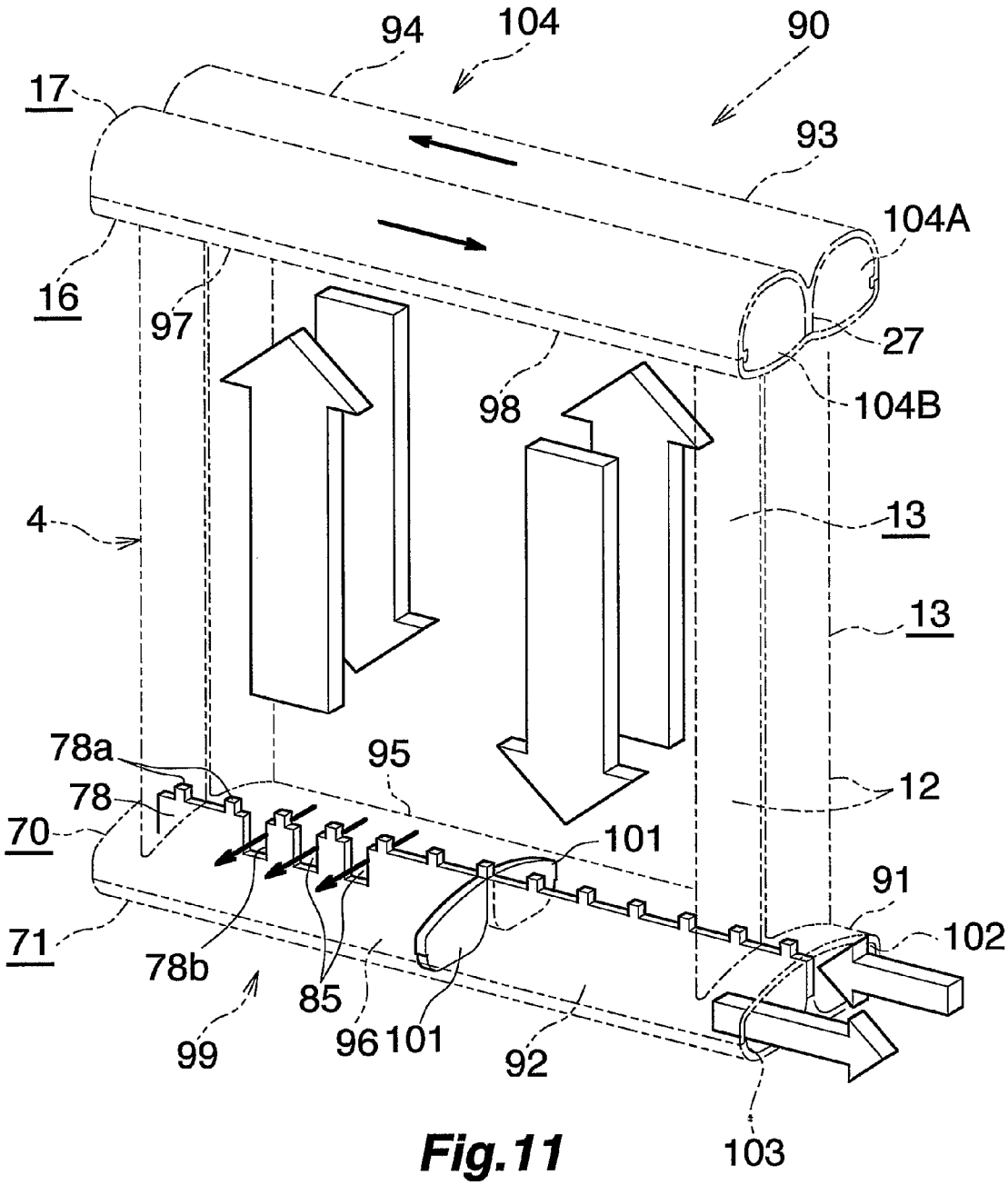
FIG. 11 is a diagram corresponding to FIG. 10 and showing a second embodiment of evaporator to which a heat exchanger of the invention is applied.

FIG. 11 shows a second embodiment of evaporator to which the heat exchanger of the invention is applied. Throughout FIGS. 1 to 11, like parts are designated by like reference numerals.

FIG. 11 shows an evaporator 90 which comprises a refrigerant inlet header 91 and a refrigerant outlet header 92 which are arranged side by side from the front rearward, a first intermediate header 93 provided above the inlet header 91 and spaced apart therefrom, a second intermediate header 94 provided on the left side of the first intermediate header 93, a third intermediate header 95 disposed below and spaced apart from the second intermediate header 94 and positioned on the left side of the inlet header 91, a fourth intermediate header 96 provided alongside the third intermediate header 95 on the rear side thereof and positioned on the left side of the outlet header 92, a fifth intermediate header 97 provided above and spaced apart from the fourth intermediate header 96 and disposed alongside the second intermediate header 94 on the rear side thereof, and a sixth intermediate header 98 disposed above and spaced part from the outlet header 92 and positioned on the right side of the fifth intermediate header 97.

The inlet header 91, outlet header 92, third intermediate header 95 and fourth intermediate header 96 are formed by separating one tank 99 into four portions arranged from the front rearward and from the left to the right. The tank 99 is similar to the refrigerant turn tank 3 of the first embodiment and comprises a first member 70 and a second member 71. The tank 99 differs from turn tank 3 with respect to the following. The tank 99 is divided into a front and a rear space by a partition wall 78 inside the tank, and each of these spaces is divided into a left and a right portion by an aluminum partition plate 101 disposed at the midportion with respect to the left-right direction, whereby four headers 91, 92, 95, 96 are provided. The portion of the partition wall 78 on the right side of the partitions plate 101 has no cutouts 78*b*, and the inlet header 91 is held out of communication with the outlet header 92. A cap 72 for the right-end openings has a refrigerant inlet 102 formed in the bottom wall of a front protrusion 81, and a refrigerant outlet 103 formed in a rear protrusion 82. Although not shown, brazed to the outer surface of the right cap 72 is a joint plate 21 having a refrigerant inlet portion 45 communicating with the inlet 102 and a refrigerant outlet portion 46 communicating with the outlet 103.

The first intermediate header 93, the second intermediate header 94, the fifth intermediate header 97 and the sixth intermediate header 98 are formed by separating one tank 104 into front and rear two divisions 104A, 104B. The right portion of the front division 104A provides the first intermediate header 93, and the left portion thereof provides the second intermediate header 94. The right portion of the rear division 104B provides the sixth intermediate header 98, and the left portion thereof provides the fifth intermediate header 97. The tank 104 is similar to the inlet-outlet tank 2 of the first embodiment in construction and comprises a first member 16 and a second member 17. The tank 104 differs from the inlet-outlet tank 2 with respect to the following. The tank 104 has no flow dividing resistance plate 29. A cap 19 for closing the right-end openings has neither of the inlet 37 and the outlet 38. The cap 19 has no joint 21 brazed thereto.

A heat exchange core 4 is provided between the assembly of the inlet header 91, outlet header 92, third intermediate header 95 and fourth intermediate header 96 and the assembly of the first intermediate header 93, second intermediate header 94, fifth intermediate header 97 and sixth intermediate header 98. Heat exchange tubes 12 of a front tube group 13 have their lower end portions joined to the inlet header 91 and the third intermediate header 95 and have their upper end portions joined to the first intermediate header 93 and the second intermediate header 94. Further heat exchange tube 12 of a rear tube group 13 have their lower end portions joined to the outlet header 92 and the fourth intermediate header 96 and have their upper end portions joined to the sixth intermediate header 98 and the fifth intermediate header 97. All the intermediate headers 93 to 98 and all the heat exchange tubes 12 provide a refrigerant circulating passage for causing the inlet header 91 to communicate with the outlet header 92.

With reference to FIG. 11 showing the evaporator 90 described, a two-layer refrigerant of vapor-liquid mixture phase flowing through a compressor, condenser and expansion valve enters the refrigerant inlet header 91 via the inlet pipe 7, the refrigerant inlet portion 45 of the joint plate 21 and the refrigerant inlet of the right cap 72 and dividedly flows into the refrigerant channels 12*a* of all the heat exchange tubes 12 joined to the inlet header 91 and included in the front tube group 13. The refrigerant flows up the channels 12*a*, enters the first intermediate header 93, and flows leftward into the second intermediate header 94. The refrigerant in this header 94 dividedly flows into the refrigerant channels 12*a* of all the heat exchange tubes 12 joined to the second intermediate header 94 and included in the front tube group 13, flows down the channels 12*a*, enters the third intermediate header 95 and flows into the fourth intermediate header 96 through the refrigerant passing holes 85 in the partition wall 78. The refrigerant in the header 96 then dividedly flows into the refrigerant channels 12*a* of all the heat exchange tube 12 joined to the fourth intermediate header 96 and included in the rear tube group 13, flows up the channels 12*a*, enters the fifth intermediate header 97 and flows rightward into the sixth intermediate header 98. The refrigerant in the header 98 then dividedly flows into the channels 12*a* of all the heat exchange tubes 12 joined to the header 98 and included in the rear tube group 13, flows down the channels 12*a* and enters the outlet header 92. The refrigerant then flows through the refrigerant outlet of the right cap 72 and the outlet portion 46 of the joint plate 21 and flows out through the outlet pipe 8.

One group 13 of heat exchange tubes is provided between the inlet header 91 and the third intermediate header 95, and the first and second intermediate headers 93, 94 of the two tanks 99, 104, and also between the outlet header 92 and the fourth intermediate header 96, and the sixth and fifth intermediate headers 98, 97, according to the foregoing second embodiment, whereas this arrangement is not limitative; one or at least two groups 13 of heat exchange tubes may be provided between the headers 91, 95 and the headers 93, 94 of the tanks 99, 104 and between the headers 92, 96 and the headers 98, 97 of the tanks. The evaporator may be used with the tank 99 positioned above the tank 104.

Figure 12:
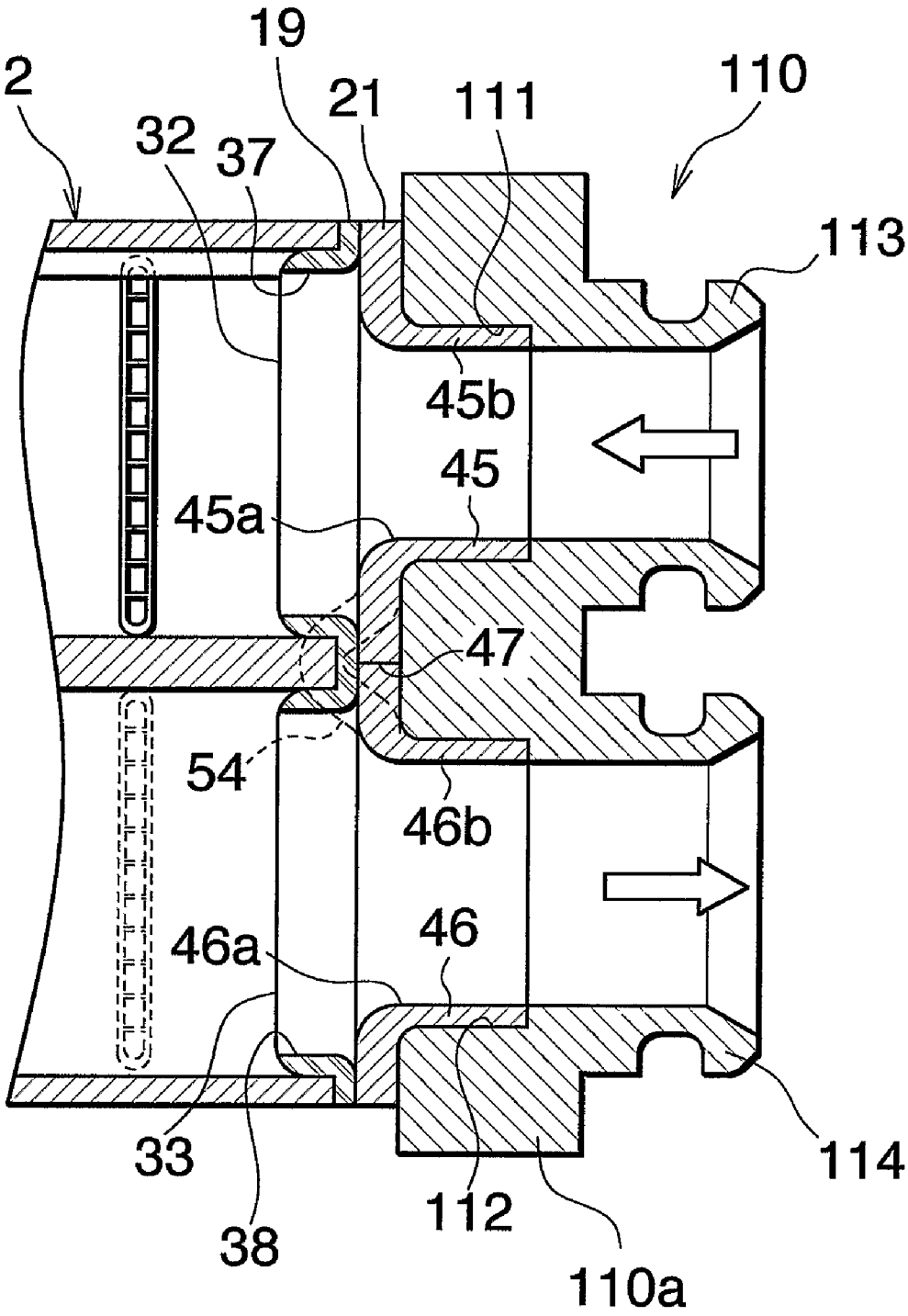
FIG. 12 is a view corresponding to part of FIG. 6 and showing a portion of the evaporator wherein an expansion valve mount member is secured to the joint plate.
Figure 13:
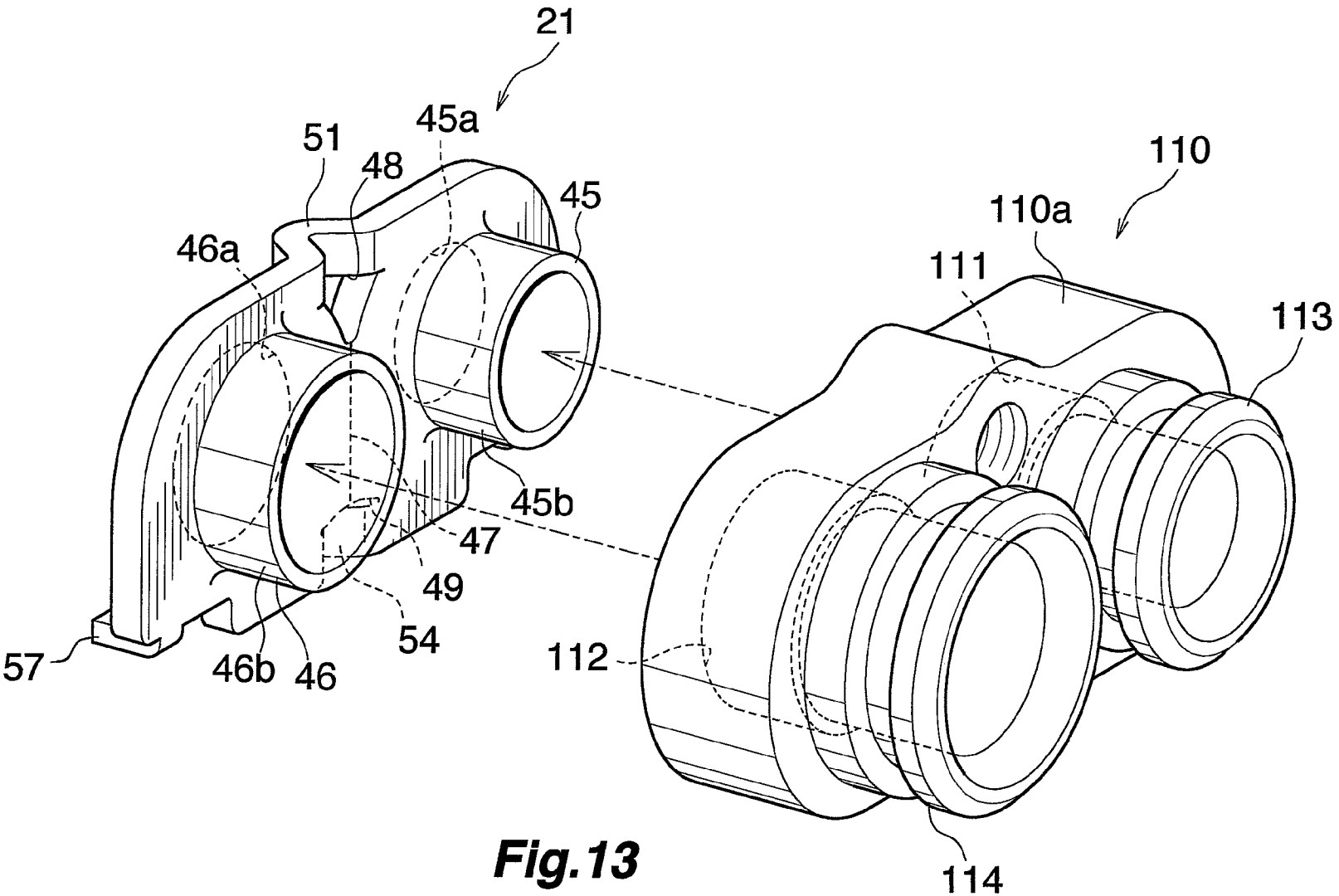
FIG. 13 is an exploded perspective view showing the joint plate and the expansion valve mount member of FIG. 12.

According to the foregoing two embodiments, the refrigerant inlet pipe 7 and the refrigerant outlet pipe 8 are joined respectively to the inlet 45 and the outlet 46 of the joint plate 21, with the expansion valve mount member secured to both the end portions of the pipes 7, 8, whereas an expansion valve mount member 110 may alternatively be joined directly to the joint plate 21 as shown in FIGS. 12 and 13.

The expansion valve mount member 110 comprises a blocklike main body 110*a* made of a metal, i.e., aluminum, and having two refrigerant passing holes 111, 112 (refrigerant passing portions) extending through the main body 110*a*, and hollow cylinders 113, 114 projecting from one side of the main body 110*a* opposite to the joint plate 21 and formed around the respective holes 111, 112 integrally with the body 110*a*.

The mount member 110 is secured to the joint plate 21 by suitable means, with the inlet 45 and the outlet 46 of the joint plate 21 inserted into the respective passing holes 111, 112 of the mount member 110 in intimate contact with the member.

Incidentally, the heat exchanger of the present invention can be embodied also as a heat exchanger of the so-called sacked plate type which comprises a plurality of flat hollow bodies arranged in parallel and each composed of a pair of dishlike plates facing toward each other and brazed to each other along peripheral edges thereof, a refrigerant inlet header and a refrigerant outlet header which are arranged in the front-rear direction, a refrigerant turn portion disposed as spaced from the two headers, a plurality of forward refrigerant passage portions for holding the inlet header in communication with the turn portion therethrough, and a plurality of backward refrigerant passage portions for holding the outlet header in communication with the turn portion, the inlet header having a refrigerant inlet at one end thereof, the outlet header having a refrigerant outlet at one end thereof alongside the inlet end, a refrigerant being permitted to flow from the inlet into the inlet header, then to flow through the forward passage portions into the turn portion where the refrigerant changes its course, thereafter to flow through the backward passage portions into the outlet header so as to be sent out from the outlet.

Although the heat exchanger of the invention is used as an evaporator according to the foregoing embodiments, this mode of embodiments is not limitative; the invention is applicable also to various other heat exchangers.

INDUSTRIAL APPLICABILITY

The present invention provides a semifinished joint plate for making a joint plate useful, for example, for motor vehicle air conditioner evaporators, to be joined to both a refrigerant inlet header and a refrigerant outlet header, and having a refrigerant inlet portion in communication with a refrigerant inlet and a refrigerant outlet portion in communication with a refrigerant outlet.

The invention claimed is:

1. In a heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, a semifinished joint plate for making a joint plate joined to both the inlet header and the outlet header and having a refrigerant inlet portion in communication with the refrigerant inlet and a refrigerant outlet portion in communication with the refrigerant outlet, the semifinished joint plate having a refrigerant inlet portion and a refrigerant outlet portion arranged in a front-rear direction at a spacing, a slit formed between the inlet portion and the outlet portion and extending upward or downward, and slit width adjusting portions extending through the thickness of the semifinished plate and communicating with respective upper and lower ends of the slit.

2. A semifinished joint plate according to claim 1 wherein the slit width adjusting portions have a dimension in the front-rear direction larger than the width of the slit in the front-rear direction.

3. A semifinished joint plate according to claim 2 wherein the slit width adjusting portions are each in the form of a generally triangular through hole and each have a width increasing as the hole extends away from the slit.

4. A semifinished joint plate according to claim 1 wherein the inlet portion and the outlet portion have respective centers positioned at the same level.

5. A semifinished joint plate according to claim 1 wherein the inlet portion and the outlet portion have respective short cylinders projecting in the same direction.

6. A semifinished joint plate according to claim 5 wherein the short cylinder of the inlet portion is smaller than the short cylinder of the outlet portion in outside diameter.

7. In a heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, a joint plate joined to both the inlet header and the outlet header and having a refrigerant inlet portion in communication with the refrigerant inlet and a refrigerant outlet portion in communication with the refrigerant outlet, the joint plate being made from a semifinished joint plate according to claim 5 by bending a portion of the semifinished joint plate above the upper slit width adjusting through hole and a portion thereof below the lower slit width adjusting through hole in a direction opposite to the direction of projection of the inlet portion and the outlet portion to thereby shorten the semifinished joint plate in the front-rear direction, decrease the width in the front-rear direction of the slit and cause the inlet portion and the outlet portion to communicate with the inlet of the inlet header and the outlet of the outlet header respectively.

8. In a heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, a joint plate joined to both the inlet header and the outlet header and having a refrigerant inlet portion in communication with the refrigerant inlet and a refrigerant outlet portion in communication with the refrigerant outlet, the joint plate being made from a semifinished joint plate according to claim 1 by bending a portion of the semifinished plate above the upper slit width adjusting portion and a portion thereof below the lower slit width adjusting portion in the direction of width of the semifinished joint plate to thereby shorten the semifinished plate in the front-rear direction, decrease the width in the front-rear direction of the slit and cause the inlet portion and the outlet portion to communicate with the inlet of the inlet header and the outlet of the outlet header respectively.

9. A joint plate according to claim 8 or 7 wherein the slit is up to 1 mm in width in the front-rear direction after adjustment.

10. A process for fabricating a joint plate according to claim 8 including making a semifinished joint plate according to claim 1 by a method including drawing a metal plate to form a refrigerant inlet bulging portion and a refrigerant outlet bulging portion both projecting in the same direction and each in the form of a short hollow cylinder having a closed top wall, forming a refrigerant inlet portion and a refrigerant outlet portion by making a through hole in the top wall of each of the bulging portions centrally thereof and raising a top wall portion defining the through hole outward to make an upright portion, stamping out a blank of specified shape from the metal plate, forming an upwardly or downwardly extending slit in the blank between the inlet portion and the outlet portion and further forming slit width adjusting portions extending through the thickness of the blank and communicating with respective upper and lower ends of the slit; and thereafter bending a portion of the semifinished joint plate above the upper slit width adjusting portion and a portion thereof below the lower slit width adjusting portion in the direction of thickness of the semifinished joint plate to thereby shorten the semifinished plate in a front-rear direction and decrease the width in the front-rear direction of the slit.

11. A process for fabricating a joint plate according to claim 10 wherein a portion of the semifinished joint plate above the upper slit width adjusting portion and a portion thereof below the lower slit width adjusting portion are bent in a direction opposite to the direction of projection of the inlet portion and the outlet portion.

12. A heat exchanger comprising a refrigerant inlet header and a refrigerant outlet header arranged side by side in a front-rear direction, and a refrigerant circulating passage for holding the two headers in communication with each other therethrough, the inlet header having a refrigerant inlet at one end thereof, the outlet header having a refrigerant outlet at one end thereof alongside the inlet end, a refrigerant being permitted to flow from the refrigerant inlet into the inlet header and to return to the outlet header through the circulating passage so as to be sent out from the refrigerant outlet, the heat exchanger further comprising a joint plate according to claim 8, the joint plate being joined to both the inlet header and the outlet header and having a refrigerant inlet portion and a refrigerant outlet portion in communication with the inlet of the inlet header and the outlet of the outlet header respectively.

13. A heat exchanger according to claim 12 wherein the refrigerant circulating passage comprises an intermediate header opposed to the inlet header, an intermediate header opposed to the outlet header, a plurality of intermediate headers opposed to each other and a plurality of heat exchange tubes, and a plurality of heat exchange tubes are arranged at a spacing between each of the opposed pair of inlet header and intermediate header, the opposed pair of outlet header and intermediate header and the opposed pair of intermediate headers to provide a tube group in the form of at least one row and constitute a heat exchange core, the heat exchange tubes of the tube group having opposite ends jointed to the respective headers of the opposed pair.

14. A heat exchanger according to claim 12 wherein the refrigerant circulating passage comprises a refrigerant inflow header opposed to the inlet header, a refrigerant outflow header opposed to the outlet header and a plurality of heat exchange tubes, the inflow header and the outflow header being in communication with each other to provide a refrigerant turn portion, and a plurality of heat exchange tubes being arranged at a spacing between each of the opposed pair of inlet header and inflow header and the opposed pair of outlet header and outflow header to provide a tube group in the form of at least one row and constitute a heat exchange core, the heat exchange tubes of the tube group having opposite ends joined to the respective headers of the opposed pair.

15. A heat exchanger according to claim 14 wherein the outlet header has interior divided by separating means into first and second two spaces arranged in the direction of height, and the heat exchange tubes extend into the first space, the separating being provided with a refrigerant passing hole, the second space of the outlet header being in communication with the refrigerant outlet.

16. A heat exchanger according to claim 12 wherein a portion of the joint plate above the upper slit width adjusting portion and a portion thereof below the lower slit width adjusting portion are bent toward the inlet header and the outlet header, and the bent portions are in engagement with respective engaging portions provided between the inlet header and the outlet header.

17. A refrigeration cycle comprising a condenser and an evaporator, the evaporator comprising a heat exchanger according to any one of claims 12 to 15.

18. A vehicle having installed therein a refrigeration cycle according to claim 17 as a vehicle air conditioner.

* * * * *